US009518706B2

(12) United States Patent
Chan et al.

(10) Patent No.: US 9,518,706 B2
(45) Date of Patent: Dec. 13, 2016

(54) LINEAR LED LIGHT MODULE

(71) Applicants: Chun Wah Chan, Peachtree City, GA (US); Anthony James Carney, Fayetteville, GA (US); Jerold Alan Tickner, Newnan, GA (US)

(72) Inventors: Chun Wah Chan, Peachtree City, GA (US); Anthony James Carney, Fayetteville, GA (US); Jerold Alan Tickner, Newnan, GA (US)

(73) Assignee: Cooper Technologies Company, Houston, TX (US)

( * ) Notice: Subject to any disclaimer, the term of this patent is extended or adjusted under 35 U.S.C. 154(b) by 72 days.

(21) Appl. No.: 14/256,344

(22) Filed: Apr. 18, 2014

(65) Prior Publication Data

US 2014/0226322 A1 Aug. 14, 2014

Related U.S. Application Data

(60) Division of application No. 13/095,349, filed on Apr. 27, 2011, now Pat. No. 8,764,220, which is a (Continued)

(51) Int. Cl.
*F21S 4/00* (2016.01)
*F21K 99/00* (2016.01)
(Continued)

(52) U.S. Cl.
CPC . *F21K 9/30* (2013.01); *F21K 9/20* (2016.08); *F21S 2/005* (2013.01); *F21S 4/008* (2013.01);
(Continued)

(58) Field of Classification Search
CPC ..... F21S 4/003; F21S 4/008; F21S 8/038; F21S 4/20; F21V 17/16; F21V 17/164; F21V 19/004
See application file for complete search history.

(56) References Cited

U.S. PATENT DOCUMENTS 3,038,139 A 6/1962 Bonanno
3,706,882 A 12/1972 Eby
(Continued)

FOREIGN PATENT DOCUMENTS

KR 20-2008-0004689 10/2008
KR 20-2008-0005381 11/2008
(Continued)

OTHER PUBLICATIONS

European Search Report mailed Oct. 20, 2015 for EP 15172482.
(Continued)

*Primary Examiner* — Julie Bannan
(74) *Attorney, Agent, or Firm* — King & Spalding LLP

(57) ABSTRACT

A linear light emitting diode ("LED") light fixture includes LED modules that interface with one another to provide a substantially continuous array of LED's. This continuous array allows for substantially uniform light output from the LED light fixture. The LED modules can interface with one another via one or more connectors, which allow two or more LED modules to be electrically and mechanically coupled together. The connectors may be disposed beneath the LED's so that the connectors are not visible when the LED modules are coupled together. The connectors may be disposed along opposite ends of the modules to allow for end-to-end configurations of the modules and/or along side ends of the modules to allow for angled or curved configurations of the modules. The LED modules can be powered via one or more wires, magnets, or clips, which are coupled to a power source.

15 Claims, 19 Drawing Sheets

Related U.S. Application Data continuation-in-part of application No. 12/617,127, filed on Nov. 12, 2009, now Pat. No. 8,308,320.

(60) Provisional application No. 61/328,875, filed on Apr. 28, 2010, provisional application No. 61/410,204, filed on Nov. 4, 2010.

(51) Int. Cl.

| | |
|---|---|
| ***F21V 15/01*** | (2006.01) |
| ***F21S 2/00*** | (2016.01) |
| ***F21V 19/00*** | (2006.01) |
| ***F21V 23/06*** | (2006.01) |
| *F21V 29/51* | (2015.01) |
| *F21V 29/00* | (2015.01) |
| *F21V 21/088* | (2006.01) |
| *F21V 17/16* | (2006.01) |
| *F21V 21/096* | (2006.01) |
| *F21V 21/30* | (2006.01) |
| *F21Y 101/00* | (2016.01) |

(52) U.S. Cl.

CPC .. *F21S 4/20* (2016.01); *F21S 4/28* (2016.01); *F21V 15/013* (2013.01); *F21V 19/003* (2013.01); *F21V 23/06* (2013.01); *F21V 17/164* (2013.01); *F21V 21/088* (2013.01); *F21V 21/096* (2013.01); *F21V 21/30* (2013.01); *F21V 29/006* (2013.01); *F21V 29/51* (2015.01); *F21Y 2101/00* (2013.01); *F21Y 2103/10* (2016.08); *F21Y 2113/13* (2016.08); *F21Y 2115/10* (2016.08)

(56) References Cited

U.S. PATENT DOCUMENTS 3,810,258 A 5/1974 Mathauser
4,302,800 A 11/1981 Pelletier
4,535,393 A 8/1985 Aspenwall
4,538,214 A 8/1985 Fisher et al.
4,617,612 A 10/1986 Pritchett
4,667,277 A 5/1987 Hanchar
4,719,549 A 1/1988 Apel
4,752,756 A 6/1988 Bartel
4,959,761 A 9/1990 Critelli et al.
5,154,509 A 10/1992 Wulfman et al.
5,291,039 A 3/1994 Ogata et al.
5,321,593 A 6/1994 Moates
5,342,204 A 8/1994 Och
5,397,238 A 3/1995 Och
5,418,384 A 5/1995 Yamana et al.
5,660,461 A 8/1997 Ignatius
5,906,427 A * 5/1999 Noh ..... F21V 19/008 362/219
6,050,044 A 4/2000 McIntosh
6,065,849 A 5/2000 Chen
6,176,760 B1 1/2001 Ngai
6,233,971 B1 5/2001 Ohlund
6,320,182 B1 11/2001 Hubble et al.
6,343,942 B1 2/2002 Okamoto
6,357,904 B1 3/2002 Kawashima
6,361,186 B1 3/2002 Slayden
6,367,948 B2 4/2002 Branson
6,422,716 B2 7/2002 Henrici et al.
6,426,807 B1 7/2002 Kawai et al.
6,509,840 B2 1/2003 Martineau
6,540,372 B2 4/2003 Joseph
6,561,690 B2 5/2003 Balestriero et al.
6,582,100 B1 6/2003 Hochstein et al.
6,585,393 B1 7/2003 Brandes
6,592,238 B2 7/2003 Cleaver et al.
6,601,970 B2 8/2003 Ueda et al.
6,612,717 B2 9/2003 Yen
6,641,284 B2 11/2003 Stopa et al.
6,641,294 B2 11/2003 Lefebvre
6,659,622 B2 12/2003 Katogi et al.
6,676,284 B1 1/2004 Willson
6,761,472 B1 7/2004 Cleaver
6,767,111 B1 7/2004 Lai
6,776,504 B2 8/2004 Sloan et al.
6,802,626 B2 10/2004 Belfer et al.
6,882,111 B2 4/2005 Kan et al.
6,932,495 B2 8/2005 Sloan et al.
6,940,659 B2 9/2005 McLean et al.
7,063,440 B2 6/2006 Mohacsi et al.
7,066,739 B2 6/2006 McLeish
7,070,418 B1 * 7/2006 Wang ..... F21K 9/00 439/56
7,101,056 B2 9/2006 Pare
7,137,727 B2 11/2006 Joseph et al.
7,159,997 B2 1/2007 Reo et al.
7,161,189 B2 1/2007 Wu
7,163,404 B2 1/2007 Linssen et al.
7,165,863 B1 1/2007 Thomas
7,201,511 B2 4/2007 Moriyama et al.
7,213,941 B2 5/2007 Sloan et al.
7,241,031 B2 7/2007 Sloan et al.
7,273,299 B2 9/2007 Parkyn et al.
7,290,913 B2 11/2007 Watanabe et al.
7,322,718 B2 1/2008 Setomoto et al.
7,322,828 B1 1/2008 Chiang
7,322,873 B2 1/2008 Rosen et al.
7,348,604 B2 3/2008 Matheson
7,377,669 B2 5/2008 Farmer et al.
7,384,170 B2 6/2008 Skegin
7,470,055 B2 12/2008 Hacker et al.
7,478,920 B2 1/2009 Nanbu
7,506,995 B2 3/2009 Thomas et al.
7,538,356 B2 5/2009 Lai
7,549,779 B2 6/2009 Genenbacher
7,572,027 B2 8/2009 Zampini et al.
7,625,104 B2 12/2009 Zhang et al.
7,677,914 B2 3/2010 Nall et al.
7,703,941 B2 4/2010 Lee
7,726,974 B2 6/2010 Shah et al.
7,731,558 B2 6/2010 Capriola
7,789,529 B2 9/2010 Roberts et al.
7,791,089 B2 9/2010 Bisberg
7,806,569 B2 10/2010 Sanroma et al.
7,806,574 B2 10/2010 Van Laanen et al.
7,815,341 B2 10/2010 Steedly et al.
7,857,482 B2 12/2010 Reo et al.
8,052,299 B2 11/2011 Lin
2002/0093832 A1 7/2002 Hamilton
2002/0114155 A1 * 8/2002 Katogi ..... F21S 2/00 362/219
2002/0141181 A1 10/2002 Bailey
2003/0048641 A1 3/2003 Alexanderson et al.
2003/0081419 A1 5/2003 Jacob
2003/0174517 A1 9/2003 Kiraly
2003/0223235 A1 12/2003 Mohacsi et al.
2004/0076004 A1 4/2004 Smith
2004/0114355 A1 6/2004 Rizken et al.
2004/0161213 A1 8/2004 Lee
2004/0201980 A1 10/2004 Fischer et al.
2005/0146899 A1 7/2005 Joseph et al.
2005/0151708 A1 7/2005 Farmer et al.
2005/0162265 A1 7/2005 Werner et al.
2005/0254241 A1 * 11/2005 Harwood ..... F21S 2/00 362/231
2005/0264473 A1 12/2005 Sibbett
2006/0093308 A1 5/2006 Ryan
2006/0120073 A1 6/2006 Pickard et al.
2006/0146531 A1 7/2006 Reo et al.
2006/0262533 A1 11/2006 Lin et al.
2006/0291235 A1 * 12/2006 Hendrikus ..... H01R 33/08 362/551
2007/0047243 A1 3/2007 Hacker et al.
2007/0121328 A1 5/2007 Mondloch et al.
2007/0147030 A1 6/2007 Lee et al.
2007/0190845 A1 8/2007 Mrakovich et al.
2007/0262725 A1 11/2007 Koren

(56) References Cited

U.S. PATENT DOCUMENTS

| | | | | |
|---|---|---|---|---|
| 2008/0030981 | A1 | 2/2008 | Mrakovich et al. | |
| 2008/0089064 | A1* | 4/2008 | Wang | F21S 2/005 362/249.01 |
| 2008/0158878 | A1 | 7/2008 | Van Laanen et al. | |
| 2008/0170367 | A1 | 7/2008 | Lai | |
| 2008/0244944 | A1 | 10/2008 | Nall et al. | |
| 2008/0266843 | A1 | 10/2008 | Villard | |
| 2008/0298058 | A1* | 12/2008 | Kan | F21S 4/003 362/240 |
| 2009/0021936 | A1 | 1/2009 | Stimac et al. | |
| 2009/0073693 | A1 | 3/2009 | Nall et al. | |
| 2009/0098764 | A1 | 4/2009 | Janos | |
| 2009/0101921 | A1 | 4/2009 | Lai | |
| 2009/0161371 | A1 | 6/2009 | Vukosic et al. | |
| 2009/0219713 | A1 | 9/2009 | Siemiet et al. | |
| 2009/0224265 | A1 | 9/2009 | Wang et al. | |
| 2009/0237011 | A1 | 9/2009 | Shah et al. | |
| 2009/0238252 | A1 | 9/2009 | Shah et al. | |
| 2009/0240380 | A1 | 9/2009 | Shah et al. | |
| 2009/0267533 | A1* | 10/2009 | Lee | G09F 9/33 315/294 |
| 2009/0279298 | A1 | 11/2009 | Mier-Langner et al. | |
| 2009/0290348 | A1 | 11/2009 | Van Laanen et al. | |
| 2009/0296381 | A1 | 12/2009 | Dubord | |
| 2009/0296412 | A1 | 12/2009 | Ogawa et al. | |
| 2009/0303712 | A1 | 12/2009 | Wung et al. | |
| 2009/0310335 | A1 | 12/2009 | Park | |
| 2009/0323334 | A1 | 12/2009 | Roberts et al. | |
| 2010/0002450 | A1 | 1/2010 | Pachler et al. | |
| 2010/0053956 | A1 | 3/2010 | Park et al. | |
| 2010/0073931 | A1 | 3/2010 | Watanabe | |
| 2010/0097804 | A1 | 4/2010 | Wung et al. | |
| 2010/0103672 | A1 | 4/2010 | Thomas et al. | |
| 2010/0103687 | A1 | 4/2010 | Pitlor | |
| 2010/0110680 | A1 | 5/2010 | Bianco et al. | |
| 2010/0118532 | A1 | 5/2010 | Liang et al. | |
| 2010/0124067 | A1 | 5/2010 | Hente et al. | |
| 2010/0135022 | A1 | 6/2010 | Deguara | |
| 2010/0142205 | A1* | 6/2010 | Bishop | F21K 9/17 362/249.02 |
| 2010/0164409 | A1 | 7/2010 | Lo et al. | |
| 2010/0182782 | A1 | 7/2010 | Ladewig | |
| 2010/0182788 | A1 | 7/2010 | Luo et al. | |
| 2010/0188846 | A1 | 7/2010 | Oda et al. | |
| 2010/0195322 | A1 | 8/2010 | Kawakami et al. | |
| 2010/0201269 | A1 | 8/2010 | Tzou et al. | |
| 2010/0214747 | A1 | 8/2010 | Jacobs et al. | |
| 2010/0220479 | A1* | 9/2010 | Yamashita | F21K 9/00 362/249.02 |
| 2010/0226125 | A1 | 9/2010 | Liao et al. | |
| 2010/0232154 | A1 | 9/2010 | Chen | |
| 2010/0254134 | A1 | 10/2010 | McCanless | |
| 2010/0271804 | A1 | 10/2010 | Levine | |
| 2010/0271834 | A1 | 10/2010 | Muessli | |
| 2010/0277098 | A1 | 11/2010 | Sarna | |
| 2010/0277666 | A1 | 11/2010 | Bertram et al. | |
| 2010/0277913 | A1 | 11/2010 | Ward | |
| 2010/0308350 | A1 | 12/2010 | Bisberg | |
| 2011/0019417 | A1 | 1/2011 | Van Laanen et al. | |
| 2011/0038147 | A1* | 2/2011 | Lin | F21K 9/17 362/235 |
| 2011/0157893 | A1 | 6/2011 | Ngai et al. | |
| 2011/0285314 | A1 | 11/2011 | Carney | |
| 2011/0297971 | A1* | 12/2011 | Shimizu | F21S 4/008 257/88 |
| 2013/0215614 | A1* | 8/2013 | Gulden | F21V 21/00 362/249.02 |
| 2015/0109804 | A1* | 4/2015 | Parekh | F21S 4/008 362/398 |

FOREIGN PATENT DOCUMENTS

| | | |
|---|---|---|
| KR | 20-2009-0009386 | 9/2009 |
| WO | WO 2005024291 | 3/2005 |
| WO | WO 2008099305 | 8/2008 |
| WO | WO 2009030233 | 3/2009 |
| WO | WO 2009035272 | 3/2009 |

OTHER PUBLICATIONS

International Search Report and Written Opinion for PCT/US2011/034133 issued on Nov. 21, 2011.

European Search Report and European Search Opinion for 11777954.6 EP, dated Feb. 12, 2014.

* cited by examiner

LINEAR LED LIGHT MODULE

RELATED APPLICATIONS

This application is a divisional application of and claims priority under 35 U.S.C. §121 to U.S. patent application Ser. No. 13/095,349, entitled "Linear LED Light Module" and filed on Apr. 27, 2011, which claims priority under 35 U.S.C. §119 to U.S. Provisional Patent Application No. 61/328,875, titled "Systems, Methods, and Devices for a Linear LED Light Module," filed on Apr. 28, 2010, and to U.S. Provisional Patent Application No. 61/410,204, titled "Linear LED Light Module," filed on Nov. 4, 2010 and which is a continuation-in-part of and claims priority under 35 U.S.C. §120 to U.S. patent application Ser. No. 12/617,127, titled "Light Emitting Diode Modules With Male/Female Features For End-To-End Coupling," filed on Nov. 12, 2009. Each of the foregoing applications is hereby fully incorporated herein by reference.

TECHNICAL FIELD

This disclosure relates generally to lighting solutions, and more particularly to systems, methods, and devices for providing linear light emitting diode ("LED") light modules.

BACKGROUND

LED's tend to be less expensive, longer lasting, and more luminous than conventional incandescent, fluorescent, and neon lamps. Therefore, many light fixture providers are opting to incorporate LED light sources into their fixture designs. However, using LED's as light sources for general illumination applications presents certain unique design challenges. For example, incorporating LED's in linear light fixtures presents challenges related to powering (or driving) the LED's, connecting the LED's, controlling the optical output of the light from the LED's, and managing the heat generated by the LED's. A need exists in the art for designs that address one or more of these design challenges for linear LED light source applications

SUMMARY

A linear light emitting diode ("LED") light fixture includes LED modules that interface with one another to provide a substantially continuous array of LED's. This continuous array allows for substantially uniform light output from the LED light fixture. The LED modules can interface with one another via one or more connectors, which allow two or more LED modules to be electrically and mechanically coupled together. The connectors may be disposed beneath the LED's so that the connectors are not visible when the LED modules are coupled together. The connectors may be disposed along opposite ends of the modules to allow for end-to-end configurations of the modules and/or along side ends of the modules to allow for angled or curved configurations of the modules. The LED modules can be powered via one or more wires, magnets, or clips, which are coupled to a power source.

These and other aspects, objects, features, and advantages of the exemplary embodiments will become apparent to those having ordinary skill in the art upon consideration of the following detailed description of illustrated exemplary embodiments, which include the best mode of carrying out the invention as presently perceived.

BRIEF DESCRIPTION OF THE DRAWINGS

Reference will now be made to the accompanying drawings, which are not necessarily drawn to scale, and wherein.

DETAILED DESCRIPTION OF EXEMPLARY EMBODIMENTS

In certain exemplary embodiments, a linear LED light fixture includes LED modules that interface with one another to provide a substantially continuous array of LED's. This continuous array allows for substantially uniform light output from the LED light fixture. In particular, this continuous array prevents undesirable shadows or breaks in the light, even at junctions between the LED modules.

The systems, methods, and apparatuses described herein may be used in retrofit applications or new light fixture designs. For example, the LED modules may replace existing linear light sources, such as fluorescent lamps, in retrofit applications. The LED modules may be used in any residential or commercial lighting application, such as cabinet, shelf, cove, and signage lighting applications, for example.

Figure 1:
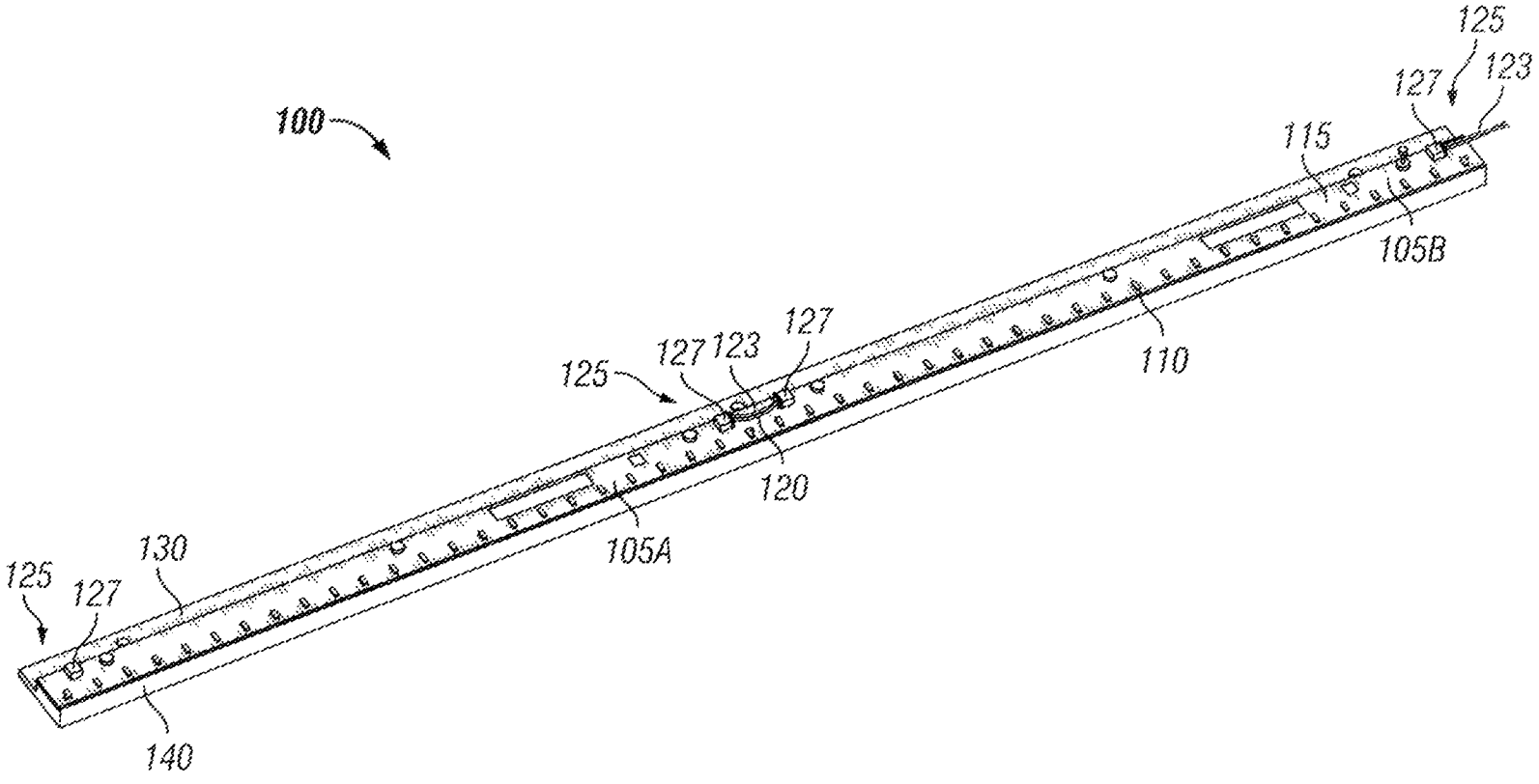
FIG. 1 is a perspective view of an LED assembly, which includes LED modules, in accordance with certain exemplary embodiments.

FIG. 1 is a perspective view of an LED assembly 100, which includes LED modules 105*a* and 105*b*, in accordance with certain exemplary embodiments. Each LED module 105 is configured to create artificial light or illumination via multiple LED's 110. Each LED 110 may be a single LED die or may be an LED package having one or more LED dies on the package. In certain exemplary embodiments, the number of dies on each LED package ranges from 1-312. For example, each LED package may include 2 dies.

Each LED module 110 includes at least one substrate 115 to which the LED's 110 are coupled. Each substrate 115 includes one or more sheets of ceramic, metal, laminate, circuit board, flame retardant (FR) board, mylar, or another material. Although depicted in FIG. 1 as having a substantially rectangular shape, a person of ordinary skill in the art having the benefit of the present disclosure will recognize that the substrate 115 can have any linear or non-linear shape. Each LED 110 is attached to its respective substrate 115 by a solder joint, a plug, an epoxy or bonding line, or other suitable provision for mounting an electrical/optical device on a surface. Each LED 110 includes semi-conductive material that is treated to create a positive-negative (p-n) junction. When the LED's 110 are electrically coupled to a power source (not shown), such as a driver, current flows from the positive side to the negative side of each junction, causing charge carriers to release energy in the form of incoherent light.

The wavelength or color of the emitted light depends on the materials used to make each LED 110. For example, a blue or ultraviolet LED typically includes gallium nitride (GaN) or indium gallium nitride (InGaN), a red LED typically includes aluminum gallium arsenide (AlGaAs), and a green LED typically includes aluminum gallium phosphide (AlGaP). Each of the LED's 110 is capable of being configured to produce the same or a distinct color of light. In certain exemplary embodiments, the LED's 110 include one or more white LED's and one or more non-white LED's, such as red, yellow, amber, green, or blue LED's, for adjusting the color temperature output of the light emitted from the LED modules 105. A yellow or multi-chromatic phosphor may coat or otherwise be used in a blue or ultraviolet LED 110 to create blue and red-shifted light that essentially matches blackbody radiation. The emitted light approximates or emulates "white," light to a human observer. In certain exemplary embodiments, the emitted light includes substantially white light that seems slightly blue, green, red, yellow, orange, or some other color or tint. In certain exemplary embodiments, the light emitted from the LED's 110 has a color temperature between 2500 and 6000 degrees Kelvin.

In certain exemplary embodiments, an optically transmissive or clear material (not shown) encapsulates at least some of the LED's 110, either individually or collectively. This encapsulating material provides environmental protection while transmitting light from the LED's 110. For example, the encapsulating material can include a conformal coating, a silicone gel, a cured/curable polymer, an adhesive, or some other material known to a person of ordinary skill in the art having the benefit of the present disclosure. In certain exemplary embodiments, phosphors are coated onto or dispersed in the encapsulating material for creating white light.

Each LED module 105 includes one or more rows of LED's 110. The term "row" is used herein to refer to an arrangement or a configuration whereby one or more LED's 110 are disposed approximately in or along a line. LED's 110 in a row are not necessarily in perfect alignment with one another. For example, one or more LED's 110 in a row might be slightly out of perfect alignment due to manufacturing tolerances or assembly deviations. In addition, LED's 110 in a row might be purposely staggered in a non-linear or non-continuous arrangement. Each row extends along a longitudinal axis of the LED module 105.

Although depicted in FIG. 1 as having one row of LED's 110, a person of ordinary skill in the art having the benefit of the present disclosure will recognize that the LED's 110 can be arranged in any number of different rows, shapes, and configurations without departing from the spirit and scope of the invention. For example, the LED's 110 can be arranged in four different rows, with each row comprising LED's 110 of a different color. In certain exemplary embodiments, each row and/or each LED 110 is separately controlled by the driver so that each row can independently be turned on and off or otherwise reconfigured.

In the exemplary embodiment depicted in FIG. 1, each LED module 105 includes 24 LED's 110. The number of LED's 110 on each LED module 105 may vary depending on the size of the LED module 105, the size of the LED's 110, the amount of illumination required from the LED module 105, and/or other factors. For example, a larger LED module 105 with small LED's 110 may include more LED's 110 than a smaller LED module 105 with large LED's 110.

Adjacent pairs of LED's 110 are spaced apart from one another by an equal or substantially equal distance, even at the joint 120 between the modules 105. This equal or substantially equal spacing across the LED modules 200 provides a continuous array of LED's 110 across the LED modules 105. Because the array is continuous, light output from the LED modules 105 is continuous, without any undesirable breaks or shadows.

In certain exemplary embodiments adjacent LED modules 105 are electrically coupled to one another via a connector 125. Each connector 125 (also called a connector assembly) can include one or more electrical wires 123 (also called a connector 123), connector receivers 127 (e.g., plugs, sockets), and/or other components that enable electrical transmission between electrical devices. In the example shown in FIG. 1, each connector assembly 125 includes a connector 123 having a first end that is coupled to a connector receiver 127 in a top side end of one LED module 105 and a second end that is coupled to a connector receiver 127 in a top side end of an adjacent LED module 105.

Because the connectors 125 extend from top side ends of the LED modules 105, and not from interfacing side ends of the LED modules 105, the LED modules 105 can engage one another without any significant gaps between the LED modules 105 or the pattern of LED's 110 on the LED modules 105. Thus, the LED modules 105 can provide a substantially continuous array or pattern of LED's 110 across the LED modules 105. As set forth below, in alternative exemplary embodiments, each connector 125 may be coupled to its corresponding LED modules 105 at other locations.

Each LED module 105 is configured to be mounted to a surface (not shown) to illuminate an environment associated with the surface. For example, each LED module 105 may be mounted to, or within, a wall, counter, cabinet, sign, light fixture, or other surface. Each LED module 105 may be mounted to its respective surface using solder, braze, welds, glue, epoxy, rivets, clamps, screws, nails, or other fastening means known to a person of ordinary skill in the art having the benefit of the present disclosure. In certain exemplary embodiments, one or more of the LED modules 105 are removably mounted to their corresponding surfaces to enable efficient repair, replacement, and/or reconfiguration of the LED module(s) 105. For example, each LED module 105 may be removably mounted to its corresponding surface via one or more screws extending through openings 130 defined in protrusions in the top side end of the LED module 105. In certain exemplary embodiments, the openings 130 are countersunk to allow the module surface to be flush and/or smooth. In alternative embodiments, the LED module 105 may utilize other mounting means than the mounting holes 130 or may locate the mounting means elsewhere on the LED module 105 (e.g., an upper portion of the LED module 105, adjacent the LED's 110).

To remove one of the LED modules 105, a person can simply disconnect the connector(s) 125 associated with the LED module 105 and unscrew the screws associated with the LED module 105. In certain exemplary embodiments, once the LED module 105 is removed, the remaining LED modules 105 may be electrically coupled to one another using one or more of the disconnected connectors 125.

The level of light a typical LED 110 outputs depends, in part, upon the amount of electrical current supplied to the LED 110 and upon the operating temperature of the LED 110. Thus, the intensity of light emitted by an LED 110 changes when electrical current is constant and the LED's 110 temperature varies or when electrical current varies and temperature remains constant, with all other things being equal. Operating temperature also impacts the usable lifetime of most LED's 110.

As a byproduct of converting electricity into light, LED's 110 generate a substantial amount of heat that raises the operating temperature of the LED's 110 if allowed to accumulate on the LED's 110, resulting in efficiency degradation and premature failure. Each LED module 105 is configured to manage heat output by its LED's 110. Specifically, each LED module 105 includes a conductive member 140 that is coupled to the substrate 115 and assists in dissipating heat generated by the LED's 110. Specifically, the member 140 acts as a heat sink for the LED's 110. The member 140 receives heat conducted from the LED's 110 through the substrate 115 and transfers the conducted heat to the surrounding environment (typically air) via convection.

Figure 2:
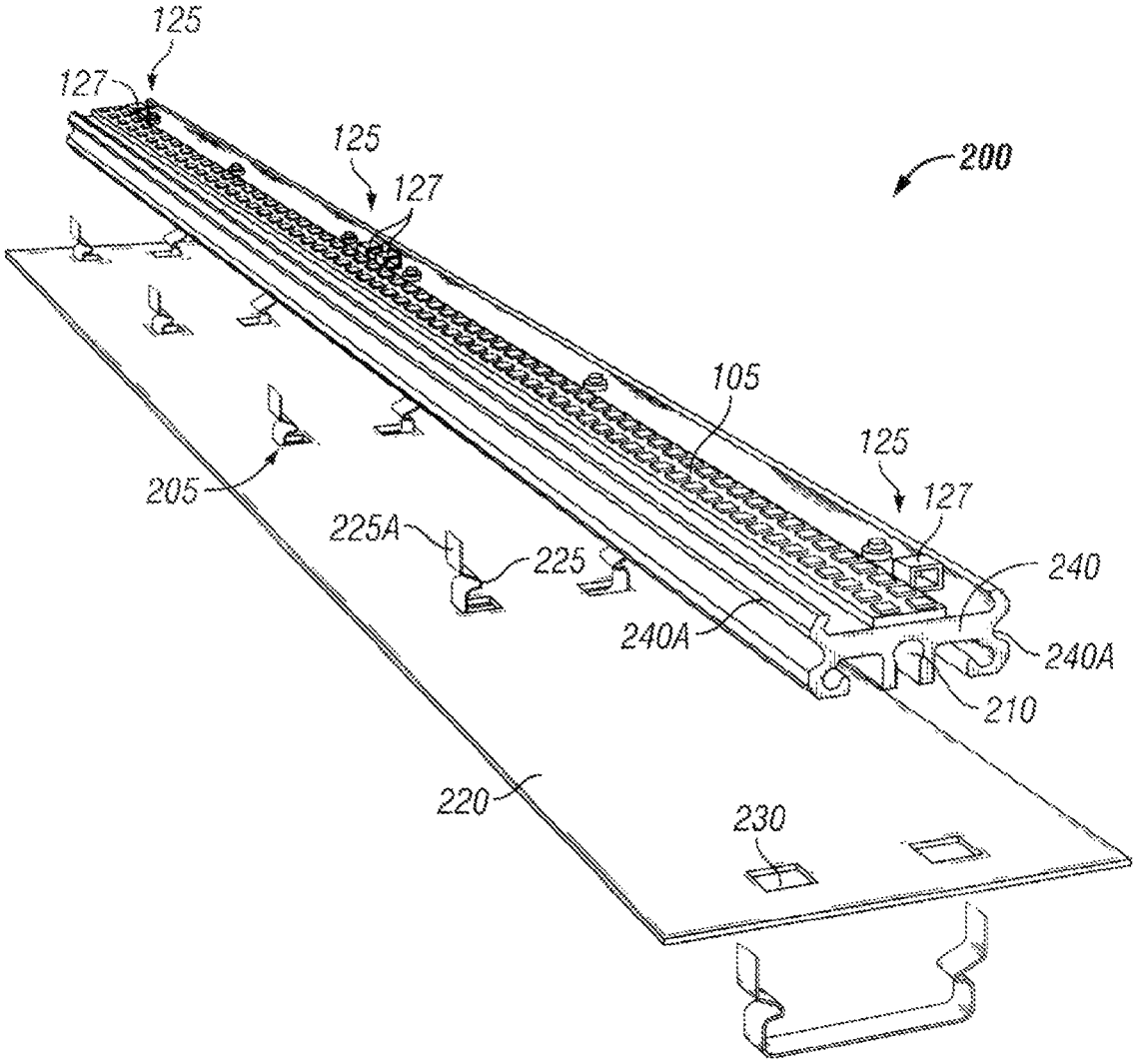
FIG. 2 illustrates an LED assembly, in accordance with certain alternative exemplary embodiments.

FIG. 2 illustrates an LED assembly 200, in accordance with certain alternative exemplary embodiments. The LED assembly 200 is similar to the LED assembly 100 described above, except that the LED assembly 200 includes snap-in features 205, a center rod mount 210, and a cover 215. The snap-in features 205 include spring clips 225 with opposing ends 225*a* that extend through openings 230 in a mounting plate 220. The ends 225*a* of the spring clips 225 engage longitudinal sides 240*a* of a member 240 to which the LED modules 105 are mounted, thereby securing the member 240 (and LED modules 105) to the mounting plate 220.

The spring clips 225 may be manipulated to mount or remove the member 240. For example, pushing the ends 225*a* of the spring clips 225 apart from one another can separate the spring clips 225 from the member 240, releasing the member 240 from the spring clips 225 mounting plate 220. Similarly, the member 240 may be mounted to the mounting plate 220 by separating the ends 225*a* of the spring clips 225, sliding the member 240 between the ends 225*a*, and releasing the ends 225*a* so that they engage the sides 240*a* of the member 240. Thus, the member 240 (and LED modules 105) is removably mounted and interchangeable in certain exemplary embodiments.

Figure 3:
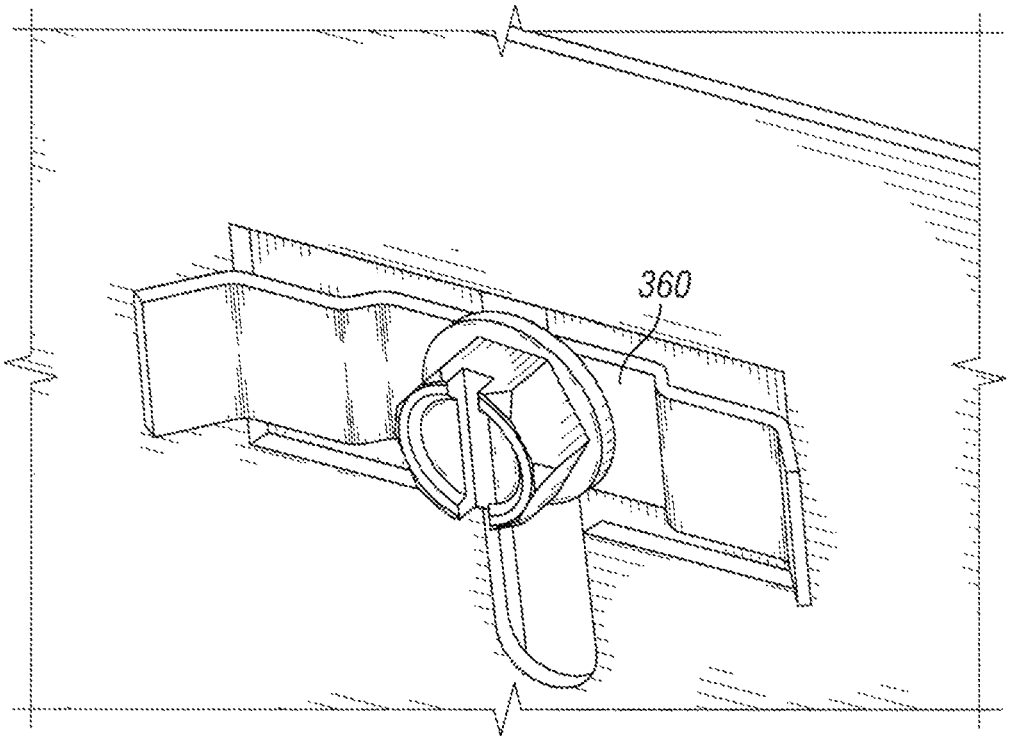
FIG. 3 illustrates mounting of a member via surface clips, in accordance with certain exemplary embodiments.
Figure 4:
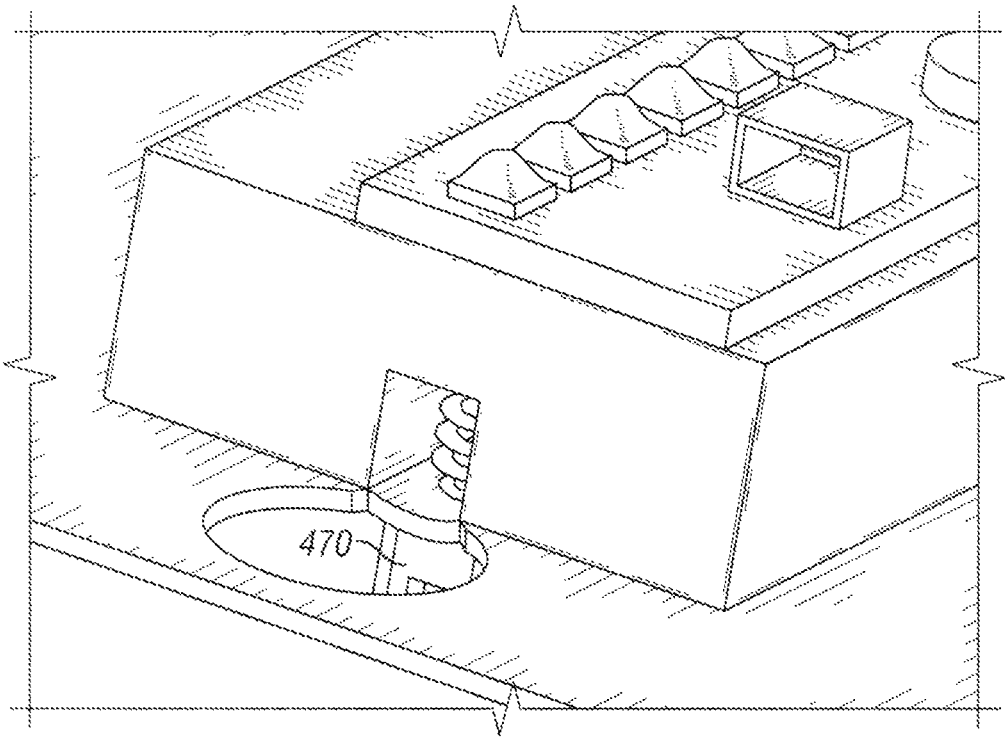
FIG. 4 illustrates mounting of a member via key hole screws, in accordance with certain exemplary embodiments

A person of ordinary skill in the art having the benefit of the present disclosure will recognize that features other than the snap-in features 205 may be used to mount the member 240, whether removably or in a fixed position, in certain alternative exemplary embodiments. For example, the member 240 may be mounted via one or more surface clips 360, as illustrated in FIG. 3, one or more keyhole screws 470, as illustrated in FIG. 4, or any other fastener.

Returning to FIG. 2, the mounting plate 220 may be mounted in any light fixture, whether in a retrofit or new fixture application. In certain exemplary embodiments, the mounting plate 220 may be soldered, brazed, welded, glued, epoxied, riveted, clamped, screwed, nailed, or otherwise fastened within an existing or new light fixture. For example, the mounting plate 220 may be mounted within an existing fluorescent light fixture, replacing fluorescent lamps with the LED modules 105. The mounting plate 220 can have a size and shape corresponding to the interior cavity of the light fixture.

The center rod mount 210 includes a channel extending at least partially along a longitudinal axis of the member 240. The channel is configured to receive at least one rod or other member (not shown), which may be manipulated to rotate or otherwise move the member 240 and LED modules 105. For example, the rod may be rotated to rotate the member 240 and LED modules 105 at least partially around an axis of the rod, thereby allowing for adjustment of the light output from the LED modules 105. Such adjustment may be particularly desired in a wall wash lighting application, for example.

The rod may be solid, hollow, or somewhere in-between. In certain exemplary embodiments, the rod includes a substantially hollow member, which acts as a heat pipe for diverting heat away from the LED module 200. Although depicted in FIG. 2A as extending along a center of the member 240, a person of ordinary skill in the art having the benefit of the present disclosure will recognize that the rod mount 210 may extend in other, off-center locations in certain alternative exemplary embodiments.

The cover (or "over optic") 215 includes a substantially elongated member that extends along the longitudinal axis of the member 240. The cover 215 is an optically transmissive element that provides protection from dirt, dust, moisture, and the like. In certain exemplary embodiments, the cover 215 is configured to control light from the LEDs 110 via refraction, diffusion, or the like. For example, the cover 215 can include a refractor, a lens, an optic, or a milky plastic or glass element.

Figure 5:
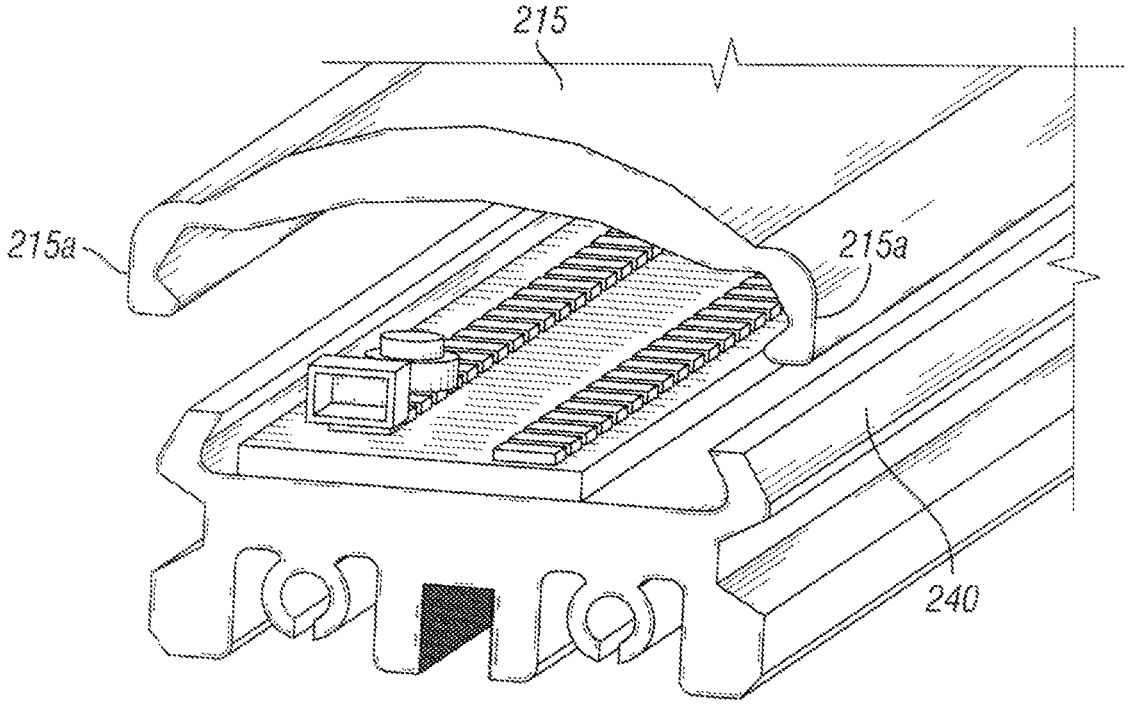
FIG. 5 illustrates a cover being coupled to a member via a snap-fit engagement, in accordance with certain exemplary embodiments.
Figure 6:
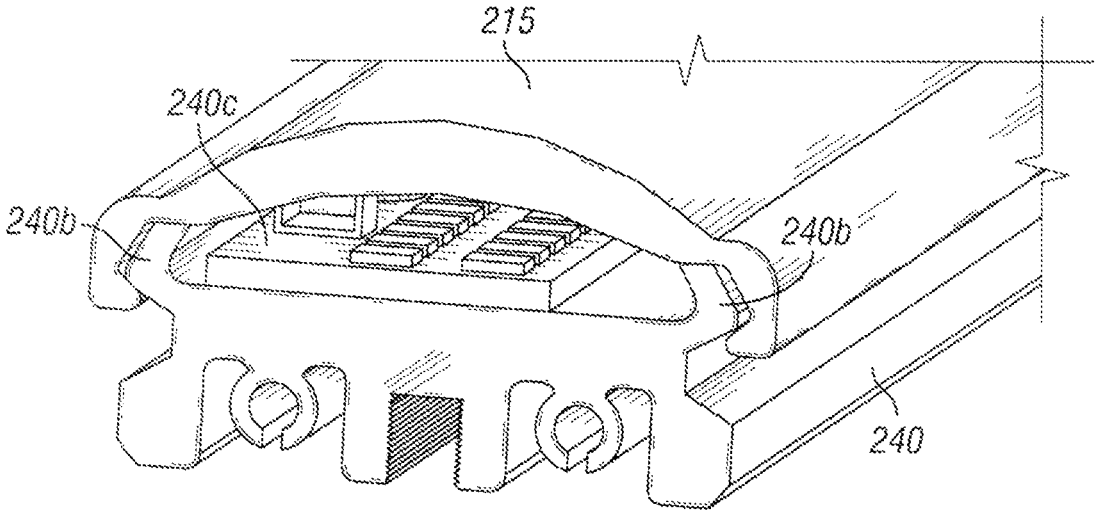
FIG. 6 illustrates the cover of FIG. 5 coupled to the member of FIG. 5, in accordance with certain exemplary embodiments

FIGS. 5 and 6 illustrate the cover 215 being coupled to the member 240 via a snap-fit engagement, in accordance with certain exemplary embodiments. Side ends 215*a* of the cover 215 are sized and shaped to interface with and partially surround protrusions 240*b* extending from the member 240, to couple the cover 215 to the member 240. In certain exemplary embodiments, the member 240 and protrusions 240*b* can be sized and shaped to accommodate covers 215 having multiple different sizes and shapes. For example, the cover 215 may be used in a retrofit application in which the assembly 200 is installed in an existing T8 light fixture, and a smaller cover 215 may be used in an application in which the assembly 200 is installed in a T5 light fixture. For example, such a smaller cover 215 may be configured such that side ends of the cover 215 are disposed within the cavity 240*c* defined by the protrusions 240*b*, with at least a portion of the ends of the cover 215 engaging interior sides of the protrusions 240*b*. For example, the side ends of the cover 215 may be disposed within one or more grooves defined by the protrusions 240*b*.

Figure 7:
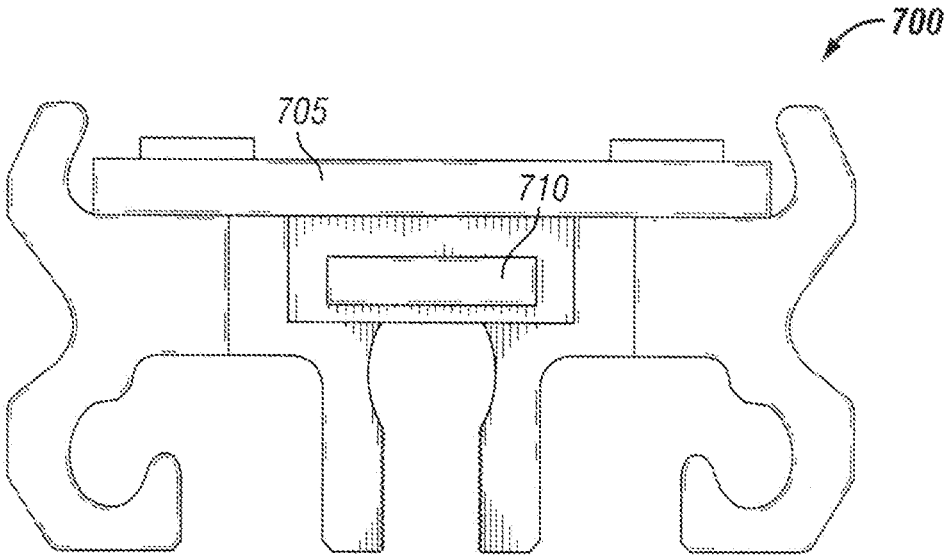
FIG. 7 is an elevational side view of an end of an LED assembly, in accordance with certain alternative exemplary embodiments.
Figure 8:
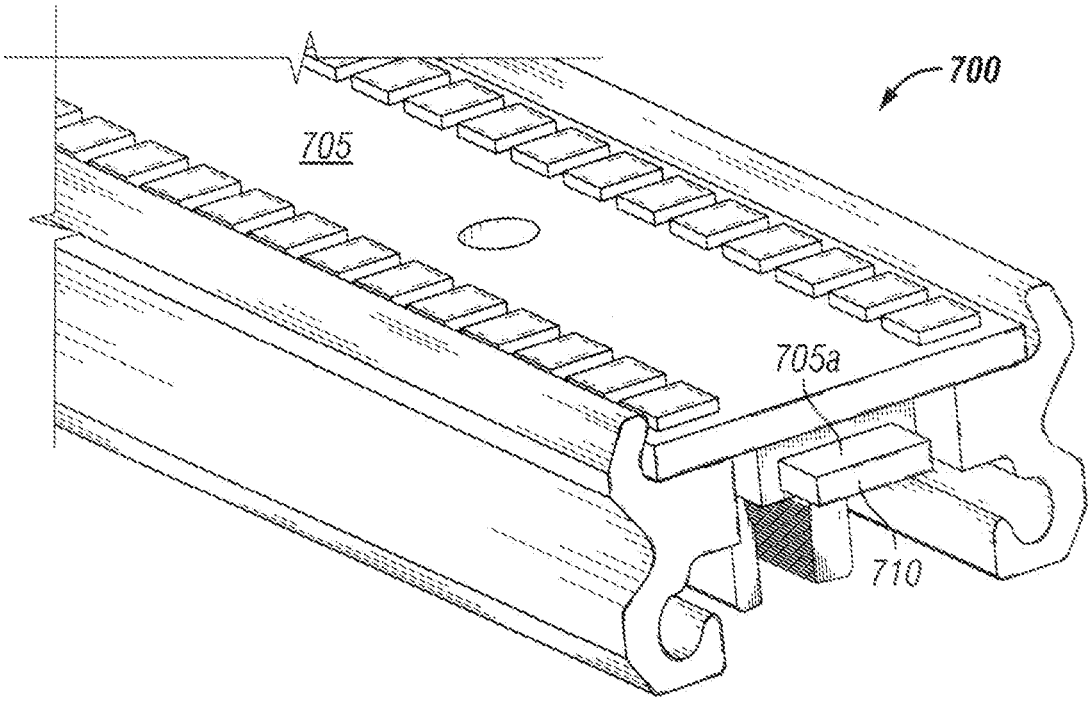
FIG. 8 is a perspective side view of the LED assembly of FIG. 7, in accordance with certain alternative exemplary embodiments.

FIG. 7 is an elevational side view of an end of an LED assembly 700, in accordance with certain alternative exemplary embodiments. FIG. 8 is a perspective side view of the LED assembly 700, in accordance with certain alternative exemplary embodiments. The LED assembly 700 is similar to the LED assemblies 100 and 200 described above, except that, instead of the LED modules 105 being connected via connectors 125 extending across top surfaces of the LED modules 105 (as in the LED assemblies 100 and 200), the LED modules 705 of the LED assembly 700 are connected to one another via connectors 710 disposed beneath the LED's 110. Each connector 710 includes one or more electrical wires, plugs, sockets, and/or other components that enable electrical transmission between the LED modules 705. For example, the connectors 710 may include one or more secure digital (SD) cards, universal series bus (USB) connectors, category 5 (Cat-5) or category 6 (Cat-6) connectors, etc.

In certain exemplary embodiments, one longitudinal end 705*a* of each LED module 700 can include a connector 710 and an opposite longitudinal end (not shown) of the LED module 700 can include a corresponding receptacle for the connector 710. Thus, the LED modules 700 may be connected end-to-end, with each connector 710 being disposed in its corresponding receptacle. Because the connectors 710 and receptacles are disposed beneath the LED's 110, the connectors 710 and receptacles are generally not visible when the LED assembly 700 is installed in a light fixture. Thus, the connectors 710 do not create any shadows or other undesirable interruptions in the light output from the LED assembly 700.

Figure 9:
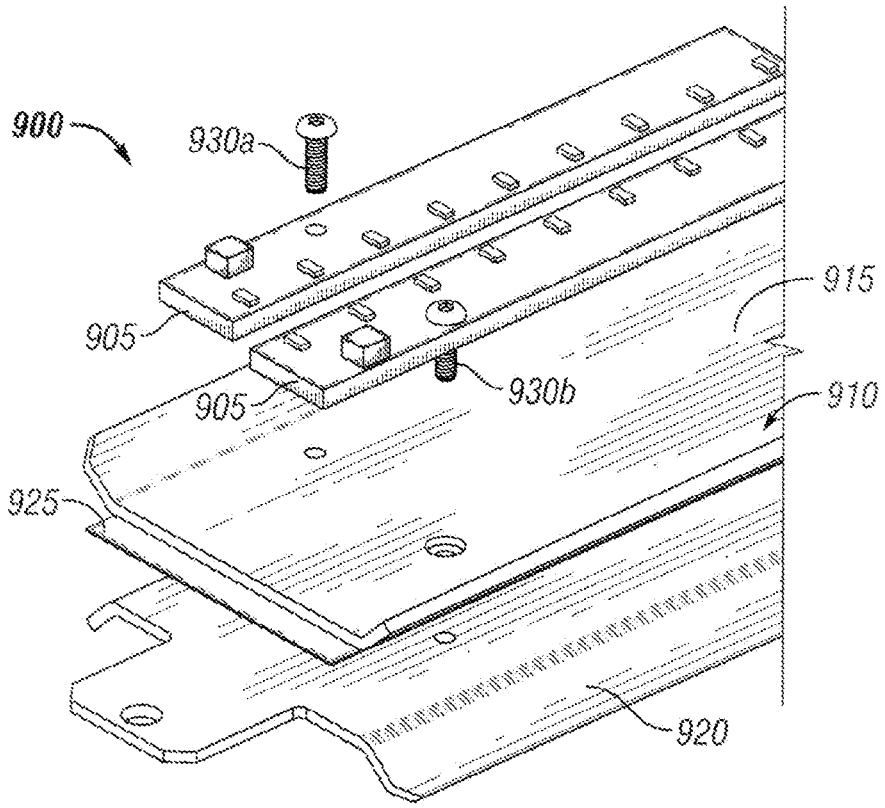
FIG. 9 is an exploded view of an LED assembly, in accordance with certain alternative exemplary embodiments.
Figure 10:
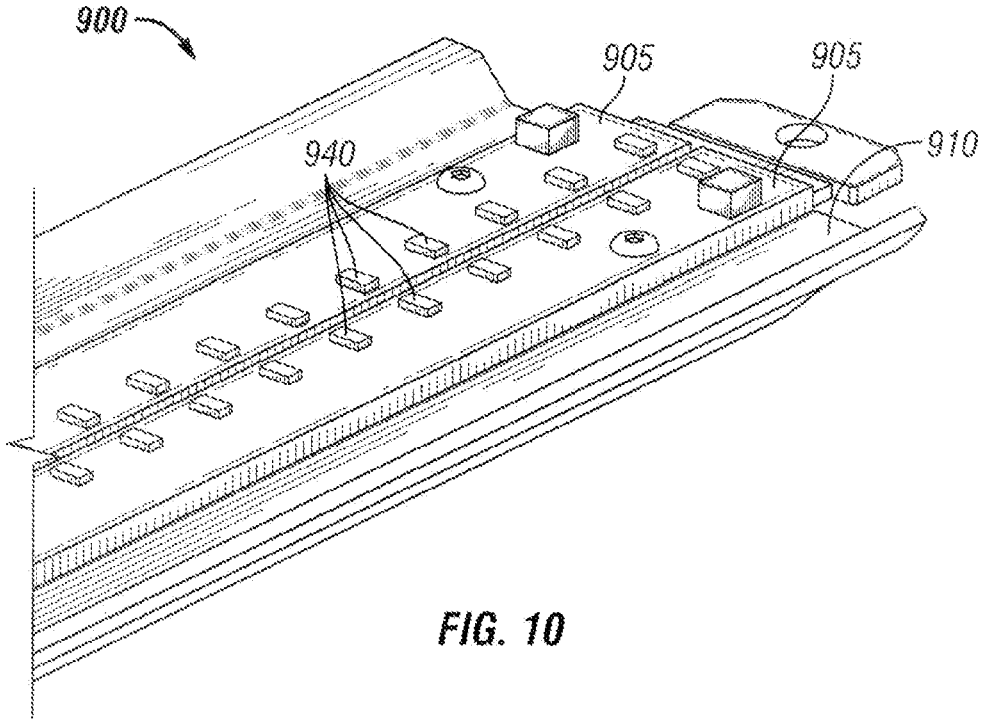
FIG. 10 is a perspective side view of the LED assembly of FIG. 9, in accordance with certain alternative exemplary embodiments.

FIG. 9 is an exploded view of an LED assembly 900, in accordance with certain alternative exemplary embodiments. FIG. 10 is a perspective side view of the LED assembly 900, in accordance with certain alternative exemplary embodiments. The LED assembly 900 is similar to the LED assemblies 100, 200, and 700 described above, except that the LED modules 905 of LED assembly 900 are coupled to powered surfaces 910, such as rails and/or tracks, which power the LED modules 905. The surfaces 910 include a first strip 915 having a first polarity and a second strip 920 having a second polarity that is different than the first polarity. A strip 925 of insulation, such as insulator film, is disposed between the first strip 915 and the second strip 920. The strip 925 electrically isolates the first strip 915 and the second strip 920.

Screws 930*a* and 930*b* make connections to either strip 915, 920. In the exemplary embodiment depicted in FIGS. 9 and 10, screw 930*a* connects to strip 915, and screw 930*b* connects to strip 920. Power may be drawn to the LED's 940 from the strips 915 and 920 via the screws 930*a* and 930*b*, without the need for additional wires or other electrical connectors.

Figure 11:
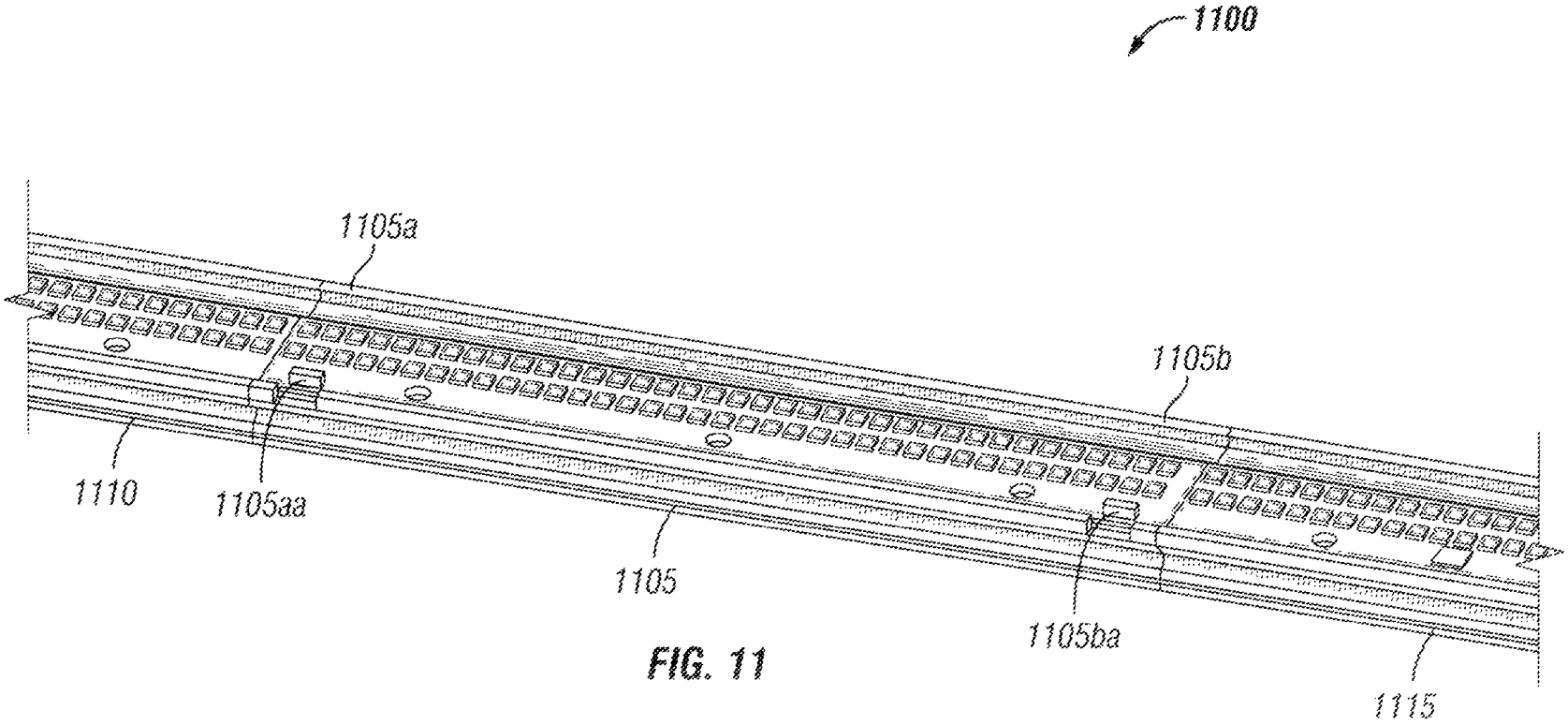
FIG. 11 is a side perspective view of an LED assembly, in accordance with certain additional alternative exemplary embodiments.

FIG. 11 is a side perspective view of an LED assembly 1100, in accordance with certain additional alternative exemplary embodiments. The LED assembly 1100 includes an LED module 1105, which powers adjacent LED modules 1110 and 1115. LED module 1105 includes first and second opposing ends 1105*a* and 1105*b*, respectively, that are electrically isolated from one another and separately powered. For example, end 1105*a* may be powered via entry point 1105*aa*, and end 1105*b* may be powered via entry point 1105*ba*. End 1105*a* provides power for LED module 1110 and may also provide power for one or more additional LED modules (not shown) coupled to LED module 1110 on a side of LED module 1110 opposite the module 1105. End 1105*b* provides power for LED module 1115 and may also provide power for one or more additional LED modules (not shown) coupled to LED module 1115 on a side of LED module 915 opposite the module 1105. The LED modules 1105, 1110, 1115 may have different (or the same) lengths. For example, LED module 1105 may have a length of two feet, and the LED modules powered by each end 1105*a*, 1105*b* of the LED module 1105 may have total lengths of about eight feet.

Figure 12:
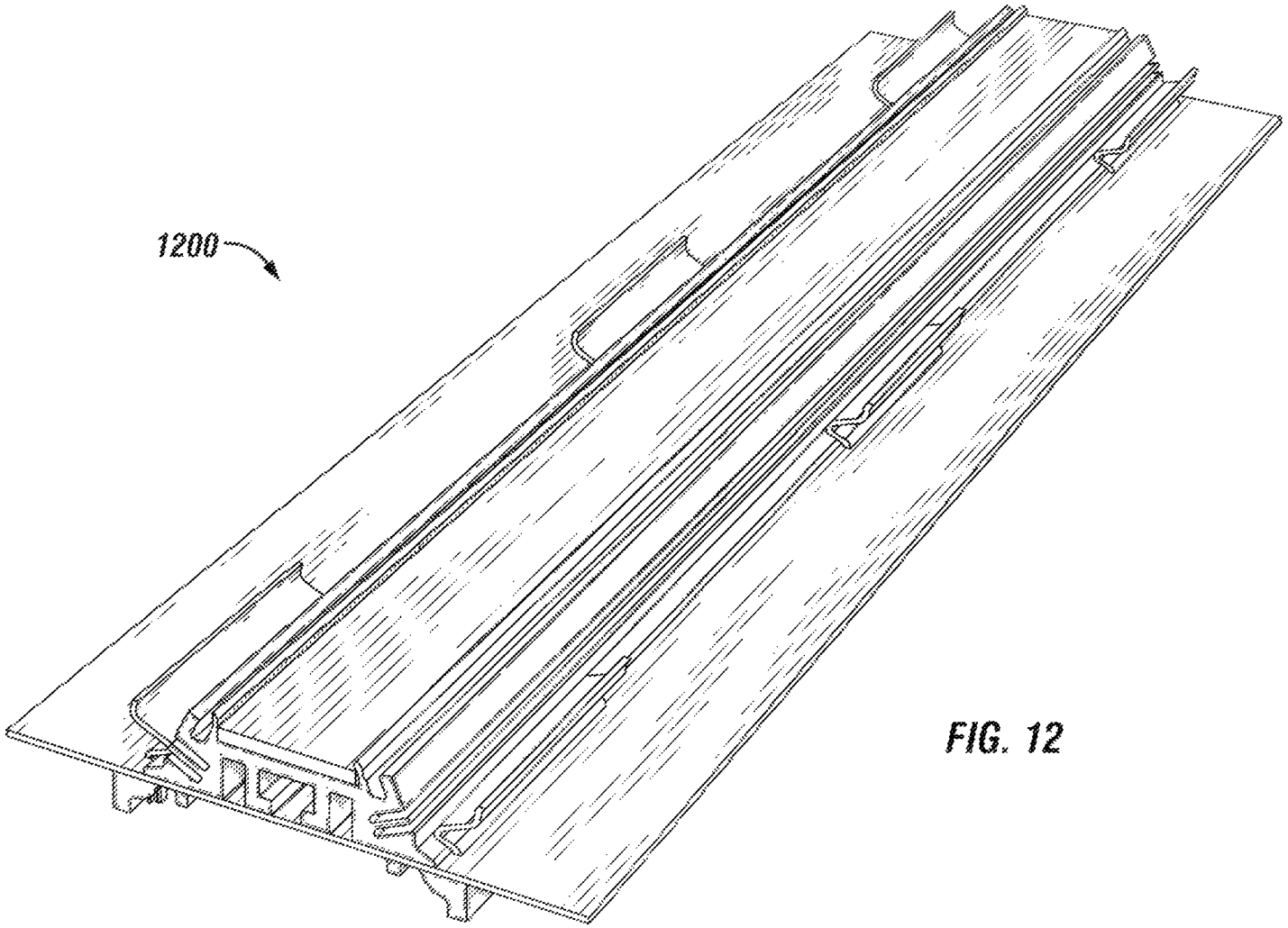
FIG. 12 is a perspective side view of an LED assembly, in accordance with certain additional alternative exemplary embodiments.
Figure 13:
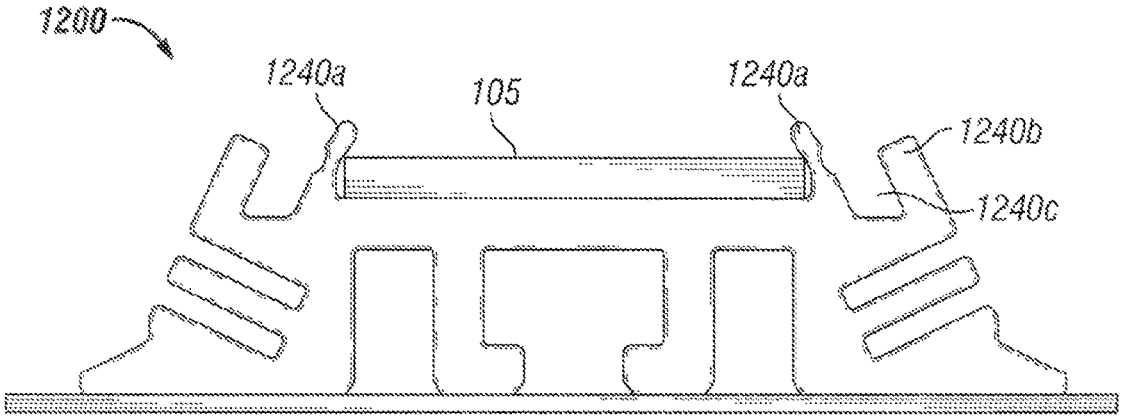
FIG. 13 is an elevational side view of an end of the LED assembly of FIG. 12, in accordance with certain additional alternative exemplary embodiments.

FIG. 12 is a perspective side view of an LED assembly 1200, in accordance with certain additional alternative exemplary embodiments. FIG. 13 is an elevational side view of an end of the LED assembly 1200, in accordance with certain additional alternative exemplary embodiments. LED assembly 1200 is similar to the LED assemblies 100, 200, and 700 above, except that the member 1240 includes multiple protrusions 1240*a* and 1240*b*. The protrusions 1240*b* are substantially similar to the protrusions 240*b* described above in connection with LED assembly 200. The protrusions 1240*a* are bendable to engage and clamp the LED modules 105 to the member 1240. In the embodiment depicted in FIGS. 12 and 13, the protrusion 1240*a* on the left is at a start (i.e., non-bent) position, and the protrusion 1240*b* on the right is in a bent position. To mount the LED modules 105 to the member 1240, the LED modules 105 may be placed between protrusions 1240*a* in their start positions, and then the protrusions 1240*a* may be bent to secure the LED modules 105 in place relative to the member 1240. In certain exemplary embodiments, the protrusions 1240*a* and 1240*b* define a cavity 1240*c* in which an end of a cover, such as the cover 215, may be positioned, substantially as described above in connection with FIGS. 5 and 6.

Figure 14:
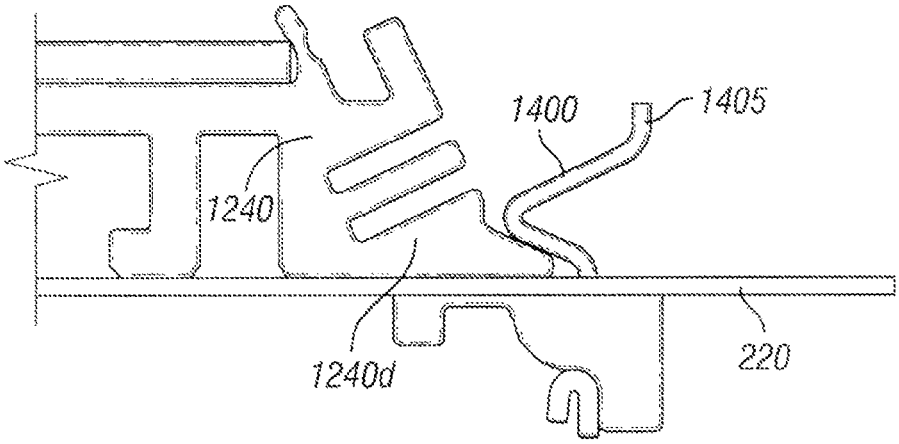
FIG. 14 illustrates a latch for securing a member to a mounting plate, in a locked position, in accordance with certain additional alternative exemplary embodiments.
Figure 15:
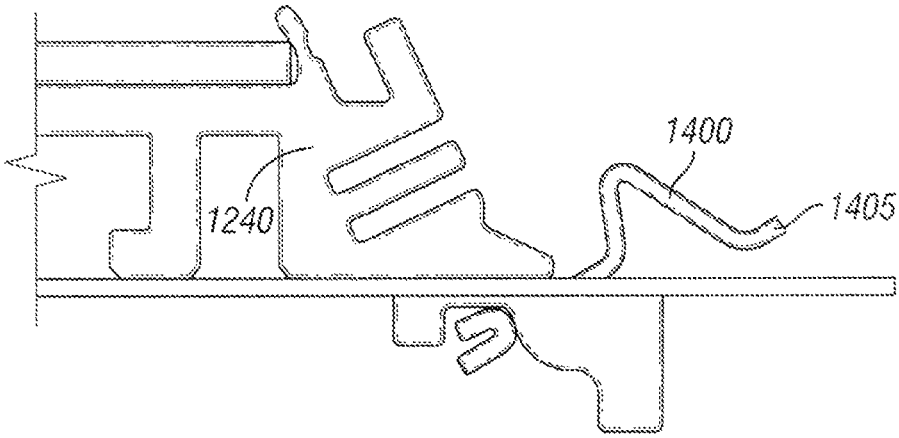
FIG. 15 illustrates a latch for securing a member to a mounting plate, in a disengaged position, in accordance with certain additional alternative exemplary embodiments.

FIGS. 14 and 15 illustrate a latch 1400 for securing the member 1240 to a mounting plate 220, in accordance with certain additional alternative exemplary embodiments. The latch 1400 includes an arm 1405 that is rotatable between an engaged or "locked" position, as illustrated in FIG. 14, and a disengaged or "unlocked" position, as illustrated in FIG. 15. In the locked position, the arm 1405 engages a bottom portion 1240*d* of the member 1240, thereby securing the member 1240 to the mounting plate 220. The arm 1405 may be rotated away from the bottom portion 1240*d* to release the member 1240 from the mounting plate 220.

Figure 16:
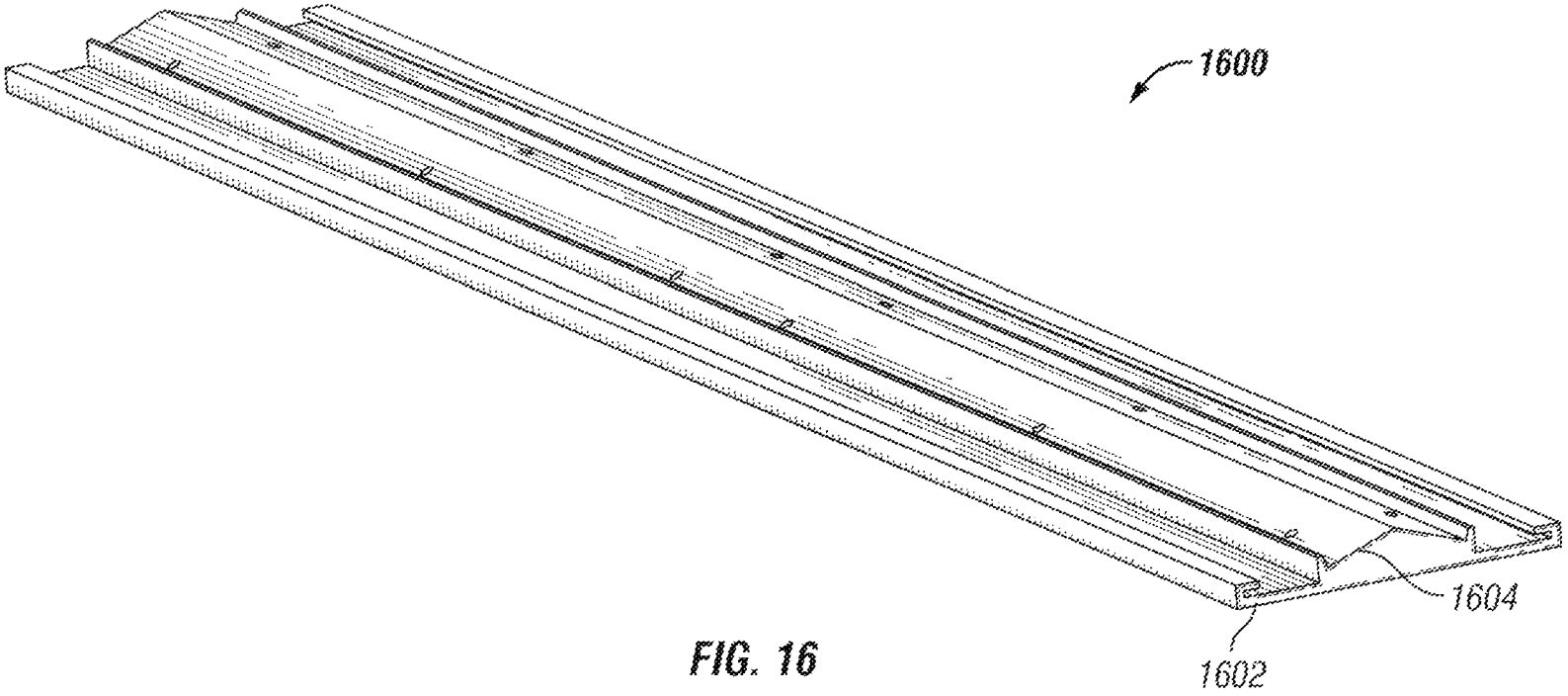
FIG. 16 illustrates an example base structure for an LED assembly, in accordance with certain alternative exemplary embodiments.

FIG. 16 illustrates an example base structure 1600 for an LED assembly, in accordance with certain alternative exemplary embodiments. For example, the base structure 1600 may be included in place of member 240 of FIG. 2, in certain exemplary embodiments. As shown in FIG. 16, the base structure 1600 may be extruded to have a lower portion 1602 and an upper portion 1604. In various example embodiments of the invention, the base structure 1600 may be a single piece or multiple parts. In the example embodiment shown in FIG. 16, the lower portion 1602 is configured to hold and/or connect with an over-optic or lens, such as a cover 215 (FIG. 2), as well as being configured to connect to a housing or heat sink (not shown).

As shown in FIG. 16, the upper portion 1604 has a triangular cross-section. The triangular shape aims the LED light sources that will be installed on the base structure 1600 at a desired angle to allow for particular optical control and/or desired light distribution. In other embodiments of the invention, different shapes and/or cross-sections of the base structure for the linear LED light modules may be used to allow for configuring the linear LED light modules in a variety of housing configurations or housing form factors for any desired lighting application or distribution.

Figure 17:
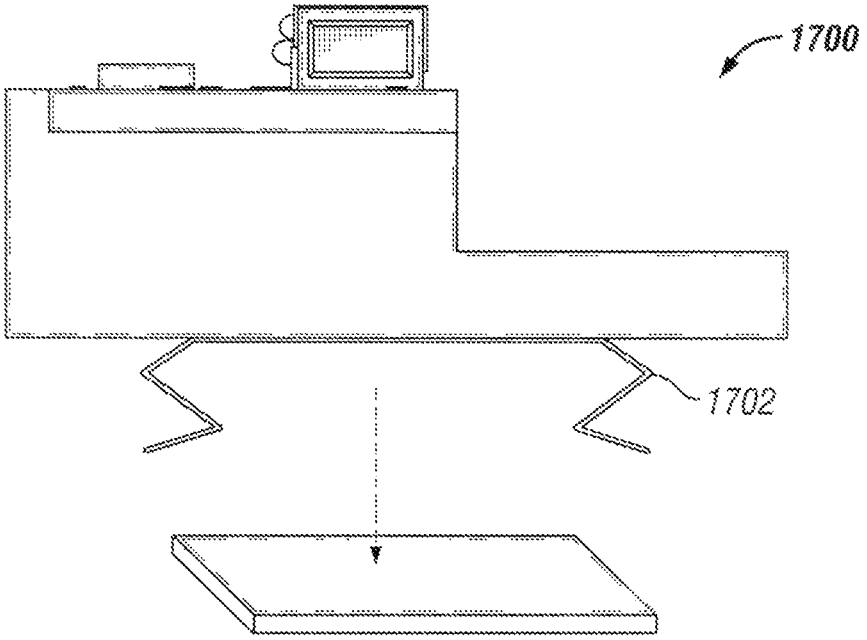
FIG. 17 is a side view of an LED assembly, in accordance with certain additional alternative exemplary embodiments.

FIG. 17 is a side view of an LED assembly 1700, in accordance with certain additional alternative exemplary embodiments. As shown in FIG. 17, a bottom side of the LED assembly 1700 includes a fastener 1702, such as a spring clip. In other embodiments, other fasteners (e.g., clips, snaps, hooks, adhesive, and/or the like) may be used. The fastener 1702 is configured to connect to a standard socket cutout, such as a standard T5 or T8 socket cutout in the case of a retrofit solution for replacing fluorescent light bulbs. In new fixture housing, bulb, light module, or subassembly designs that incorporate one or more of the exemplary embodiments, the fastener 1702 may be designed and used such that it allows for the easy snap-in of the LED assembly 1700 to the fixture housing, bulb, light module, or subassembly. In certain exemplary embodiments, the snap-in capability allows for easier manufacturing, installation, and/or maintenance of the LED assembly 1700 and/or the light fixture incorporating the LED assembly 1700.

Figure 18:
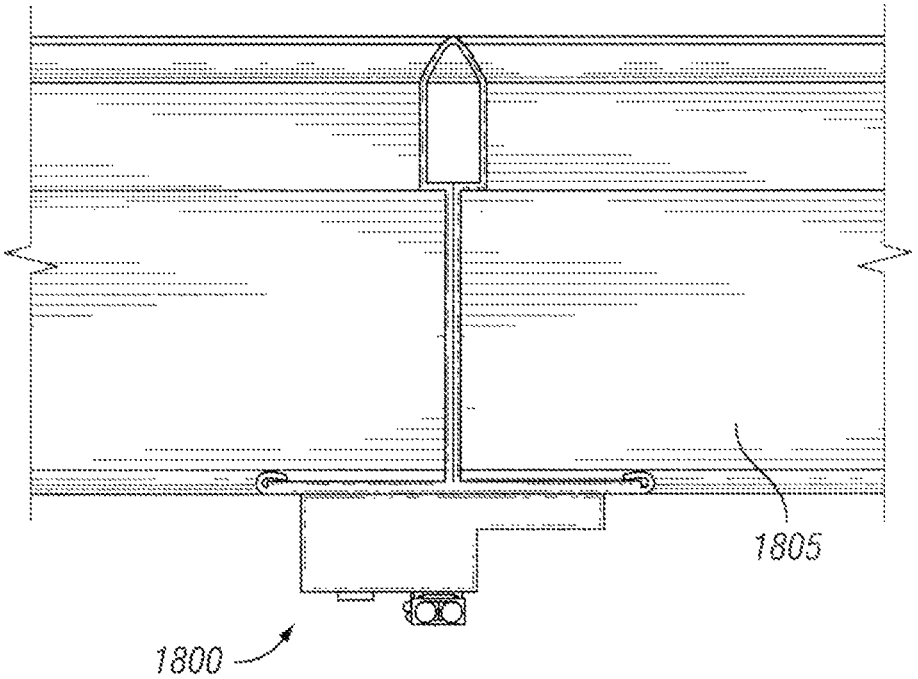
FIG. 18 is a side view of an LED assembly installed on a structure, in accordance with certain exemplary embodiments.

FIG. 18 is a side view of an LED assembly 1800 installed on a structure 1805, in accordance with certain exemplary embodiments. As shown in FIG. 18, the LED assembly 1800 may be affixed directly to a structure 1805, such as a ceiling grid, wall panel, heat sink, fixture housing, and/or the like. In an example embodiment of the invention where the structure 1805 is a ceiling grid or wall panel, the LED assembly 1800 may have a driver mounted in the ceiling or wall such that it is remotely located from the LED assembly 1800. In some example embodiments, the LED assembly 1800 may have one or more lenses (not shown) covering the LED source(s) or the entire top surface of the LED assembly 1800. The lens may be diffused or non-diffused depending on the desired application and appearance.

Figure 19:
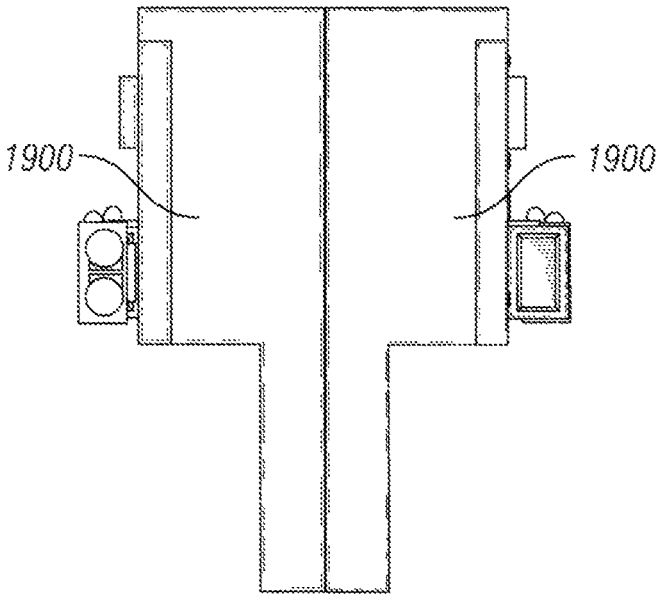
FIG. 19 illustrates two LED assemblies assembled in a back-to-back configuration, in accordance with certain exemplary embodiments.

FIG. 19 illustrates two LED assemblies 1900 assembled in a back-to-back configuration, in accordance with certain exemplary embodiments. In this configuration, the LED assemblies 1900 may be used for up and down light distributions or side-to-side light distributions. The configuration may be used as substitutes or replacements for existing linear light bulbs such as linear fluorescent fixtures. In other embodiments, a single module with LEDs (and/or other components) on the top and bottom surfaces of the module may be used rather than two modules in a back-to-back configuration.

Figure 20:
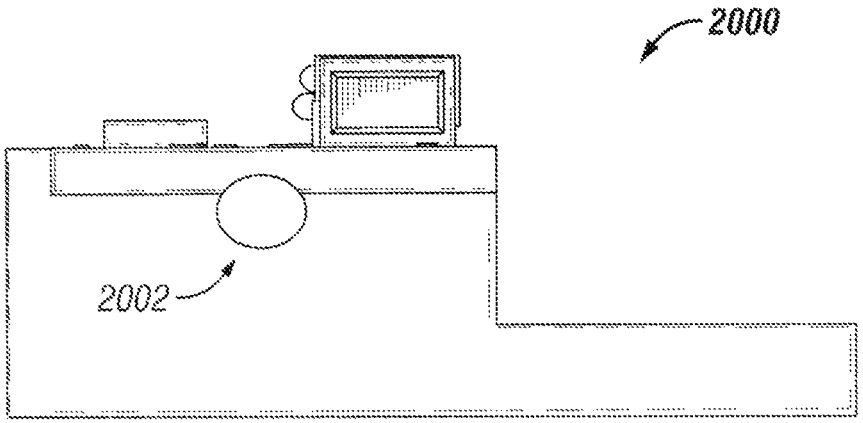
FIG. 20 is a cross-sectional view of an LED assembly, which includes a heat pipe, in accordance with certain exemplary embodiments.

FIG. 20 is a cross-sectional view of an LED assembly 2000, which includes a heat pipe 2002, in accordance with certain exemplary embodiments. The heat pipe 2002 may be incorporated into the assembly 2000 to reduce and/or transfer heat in, for example, high density applications where either the assembly 2000 includes many LEDs and/or heat transfer is an issue. The incorporation of heat pipes 2002 may also be useful where assemblies 2000 include LEDs (and/or other components) on the top and bottom surfaces of the assembly 2000 or where assemblies 2000 are in back-to-back configurations as discussed above with reference to FIG. 19.

Figure 21:
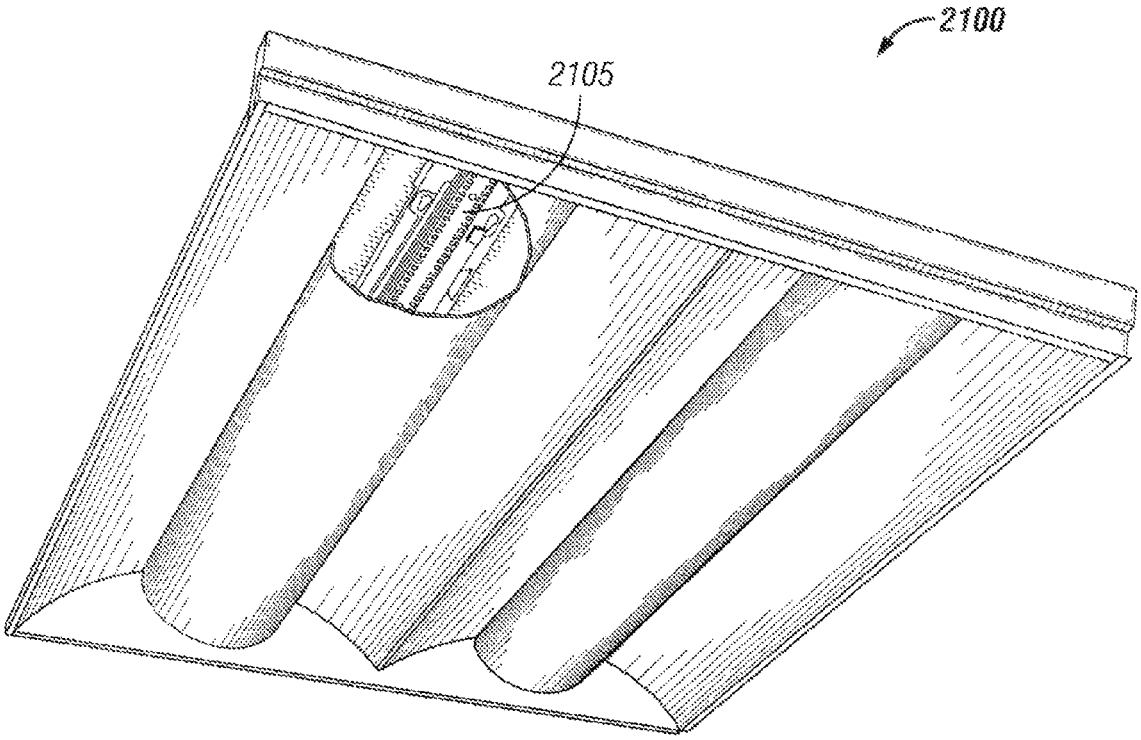
FIG. 21 illustrates a light fixture, which includes LED assemblies, in accordance with certain exemplary embodiments.

FIG. 21 illustrates a light fixture 2100, which includes LED assemblies 2105, in accordance with certain exemplary embodiments. The light fixture 2100 is a troffer fixture, which is designed for overhead lighting applications. Traditionally, troffers have included fluorescent light sources. The troffer 2100 of FIG. 21 includes LED assemblies 2105, which extend along a length of the troffer 2100 in place of fluorescent lamps. The LED assemblies 2105 may be included in a new troffer 2100 or in a retrofit of an existing troffer 2100. The LED assemblies 2105 may be the same as or different than the various LED assembly embodiments described above. A person of ordinary skill in the art will recognize that the troffer 2100 is merely exemplary and that, in certain alternative exemplary embodiments, the LED assemblies 2105 can be included in other types of light fixtures, whether overhead, wall-mounted, pole-mounted, or otherwise.

Accordingly, many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of this application. Although specific terms are employed herein, they are used in a generic and descriptive sense only and not for purposes of limitation.

Figure 22:
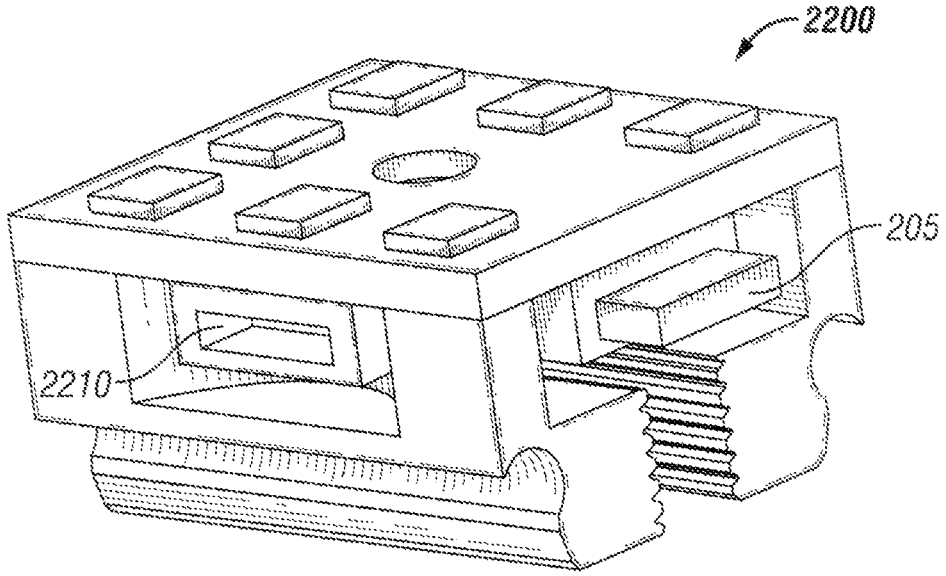
FIG. 22 illustrates an LED assembly connector, in accordance with certain exemplary embodiments.
Figure 23:
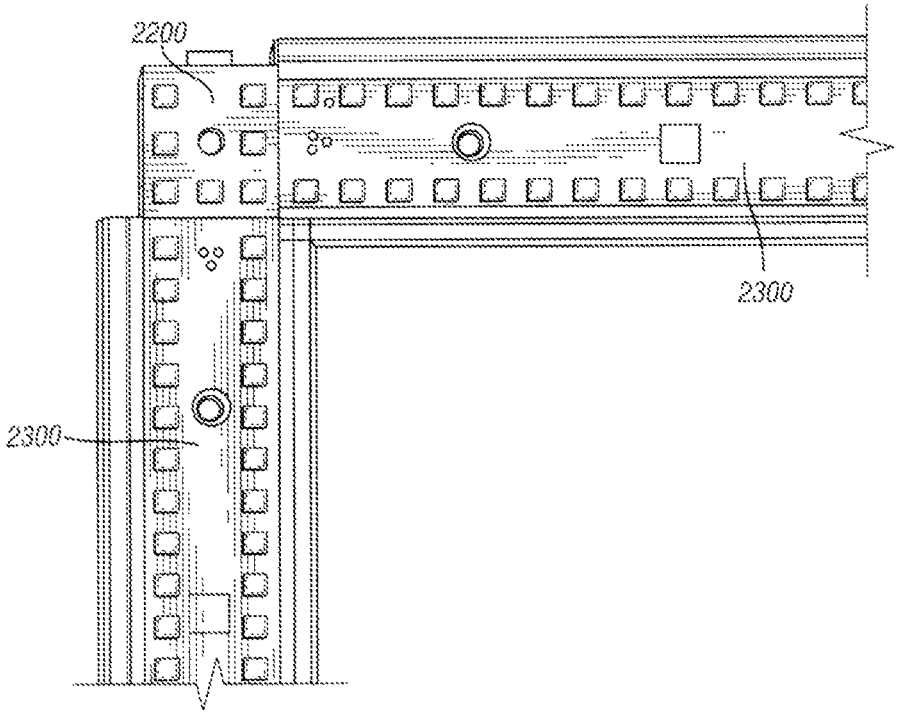
FIG. 23 illustrates LED assemblies coupled together via a connector, in accordance with certain exemplary embodiments.

FIG. 22 illustrates an LED assembly connector 2200, in accordance with certain exemplary embodiments. The connector 2200 is similar to the LED assembly 700 of FIG. 7, except that the connector 2200 includes multiple connection points for joining together multiple LED modules, such as module 705 of FIG. 7. For example, the connector 2200 can include one or more male connectors 2205 and one or more female connectors 2210, which are configured to couple together with corresponding female connectors and male connectors, respectively, of mating LED modules. For example, FIG. 23 illustrates LED assemblies 2300 coupled together via a connector 2200, in accordance with certain exemplary embodiments.

Although depicted in the figures as a substantially rectangular member, which couples LED assemblies 2300 together at right angles, a person of ordinary skill in the art will recognize that the connector 2200 can have any shape and can couple the LED assemblies 2300 together in any configuration. For example, the LED connector 2200 may have a substantially curved shape in certain alternative exemplary embodiments. In addition, although depicted in the figures as having a substantially smaller length than the lengths of the LED assemblies 2300, the LED connector 2200 can have any length, whether longer or shorter than—or the same as—the length of the LED assemblies 2300, in certain alternative exemplary embodiments. Further, the connection points 2205 and 2210 may be located somewhere other than along the bottom side of the connector 2200 in certain alternative exemplary embodiments. For example, the connection points 2205 and 2210 may be located along a top side of the connector 2200, similar to the connector 125 of FIG. 1, in certain alternative exemplary embodiments.

In the embodiment shown in FIG. 22, the connector 2200 includes a bottom structure 2220, which may provide structural support, and/or dissipate heat from, the LED's on the connector 2200, substantially as with the members 140, 240, and 1600 described above. The connector 2200 also may provide power to the LED's, as described in connection with the surfaces 910 of FIG. 9, in certain exemplary embodiments. In certain alternative exemplary embodiments, the connector 2200 may not include LED's.

Figure 24:
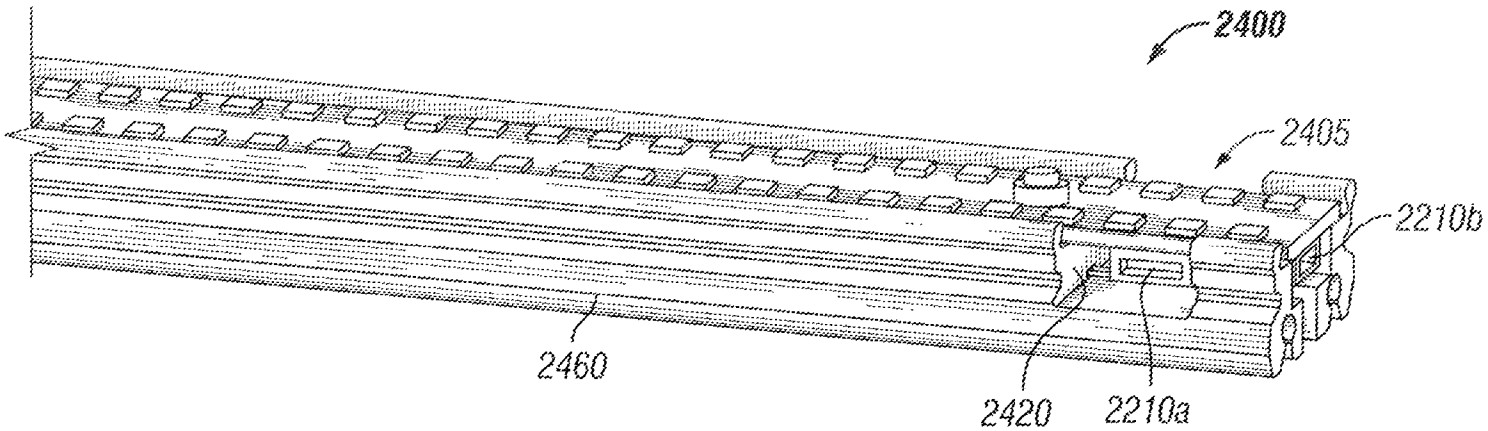
FIG. 24 illustrates an LED assembly, which includes an integral connector feature, in accordance with certain additional alternative exemplary embodiments.

FIG. 24 illustrates an LED assembly 2400, in accordance with certain additional alternative exemplary embodiments. The LED assembly 2400 is similar to those described in FIGS. 22 and 23, except that the LED assembly 2400 includes an integral connector feature 2405, which enables multiple LED assemblies (that may or may not be similar to the LED assembly 2400 or other of the assemblies described herein) to be coupled to the LED assembly 2400. For example, one additional LED assembly (not shown) may couple to the LED assembly 2400 via a first connector 2210*a* integral in an end of the LED assembly 2400, and another additional LED assembly (not shown) may coupled to the LED assembly 2400 via a second connector 2210*b* integral in the end of the LED assembly 2400. The bottom structure 2460 of the LED assembly 2400 includes a cut-out portion 2420 around the connector 2410*a*, to allow the mating assemblies adequate room to interface at the connection point. As would be recognized by a person of ordinary skill in the art, the size and shape of the cut-out portion 2420 may vary depending on the sizes and shapes of the mating assemblies.

Figure 25:
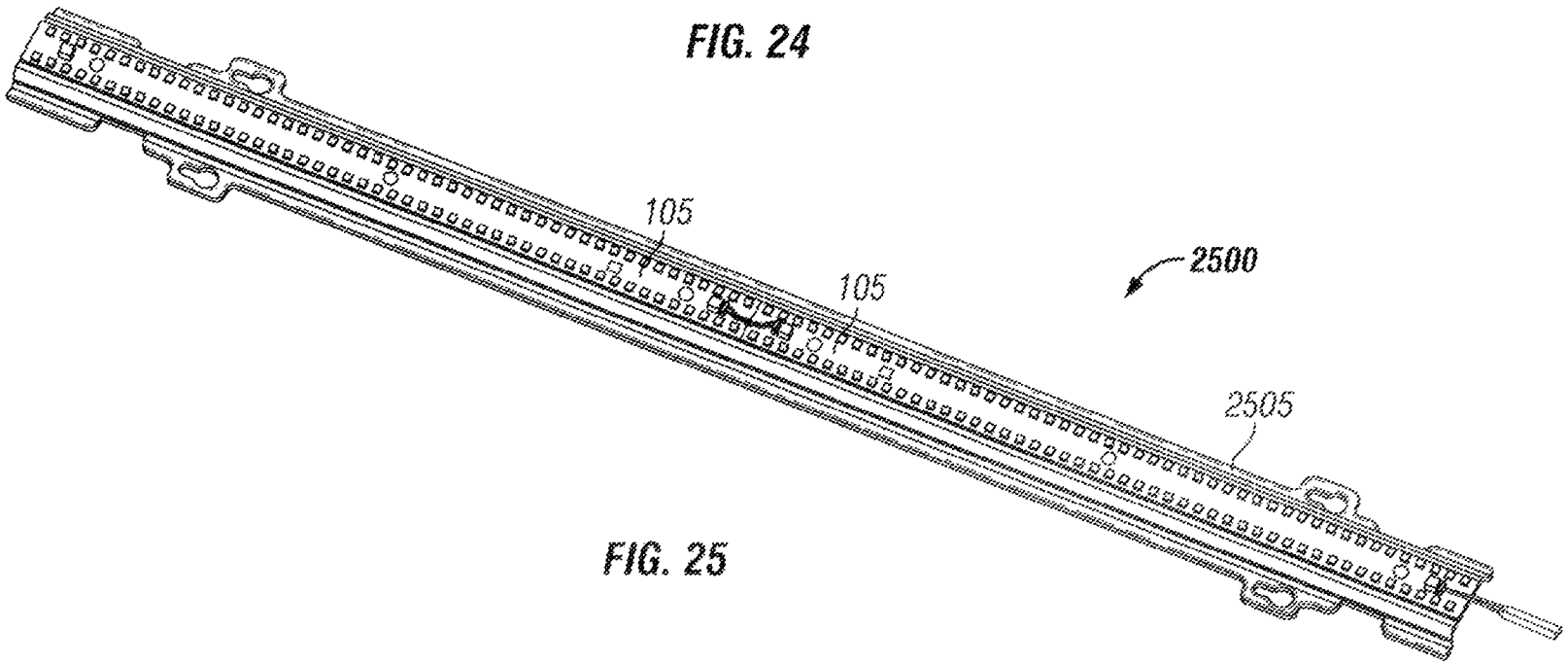
FIG. 25 illustrates an LED assembly, in accordance with certain additional alternative exemplary embodiments.

FIG. 25 illustrates an LED assembly 2500, in accordance with certain additional alternative exemplary embodiments. The LED assembly 2500 is substantially similar to the assembly 100 described above in connection with FIG. 1, except that, instead of being mounted to a member 140, the LED modules 105 are mounted to a bracket 2505, such as a sheet metal 2505. The bracket 2505 is typically used when being used in conjunction with a tooled housing when the tool housing includes features that the bracket 2505 attached to more easily than the member 140. The bracket 2505 can also have a manufacturing cost that is less than the member 140.

Figure 26:
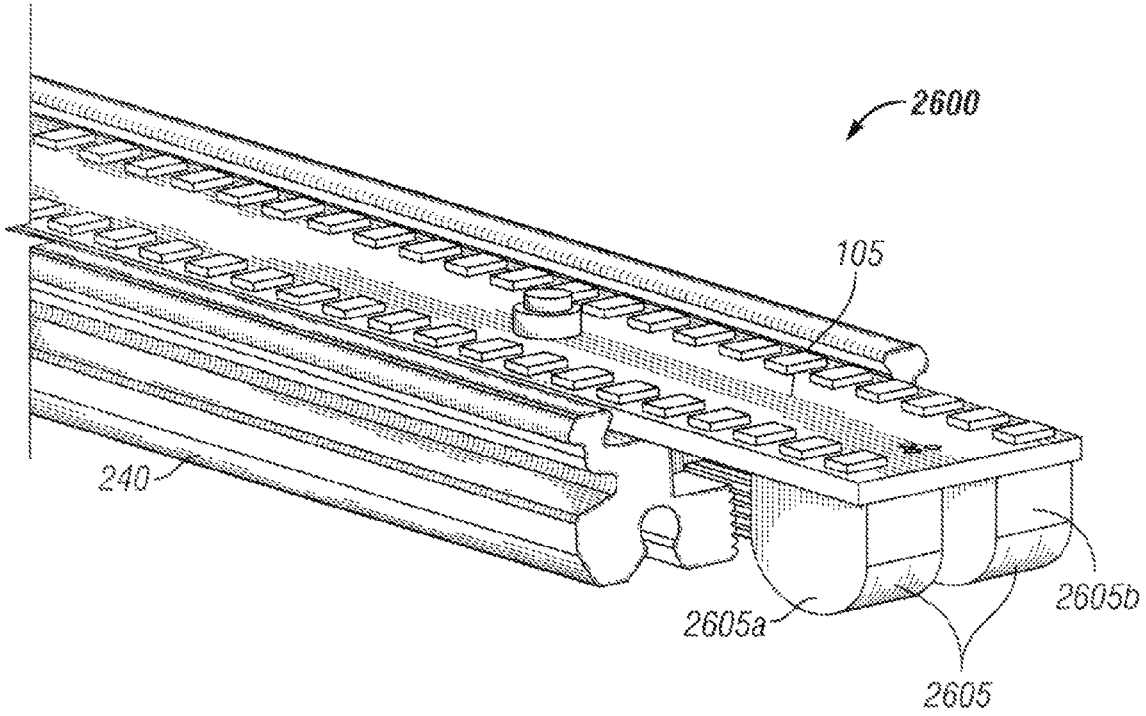
FIG. 26 illustrates an LED assembly, in accordance with certain additional alternative exemplary embodiments.

FIG. 26 illustrates an LED assembly 2600, in accordance with certain additional alternative exemplary embodiments. The LED assembly 2600 is similar to assembly 700 described above, except that one or more magnets 2605*a* and 2605*b* couple the assembly 2600 (including LED modules 105 and member 240 to a desired surface. For example, the magnets 2605*a* and 2605*b* may be mounted to the surface via an adhesive, one or more screws, or other fastening means, and a magnetic force between the magnets 2605*a* and 2605*b* and the LED modules 105 can couple together the magnets 2605*a* and 2605*b* and the LED modules 105. Thus, the magnets 2605*a* and 2605*b* may mechanically couple together the LED modules 105 and member 240 without the need for—or in addition to—mechanical fasteners, such as screws, rivets, etc.

Similar to the embodiment described above with respect to FIGS. 9 and 10, the magnets 2605*a* and 2605*b* can electrically couple the LED assembly 2600 to a powered surface, such as a rail and/or track, which powers the LED modules 105. The magnet 2605*a* can have a first polarity, and the magnet 2605*b* can have a second polarity that is different than the first polarity. The magnets can be insulated, e.g., by being coated with an anodized material, to electrically isolate the magnets 2605*a* and 2605*b* with respect to one another. Power may be provided to the LED's of the LED modules 105 via the magnets 2605*a* and 2605*b* without the need for additional wires or other electrical connectors.

Figure 27:
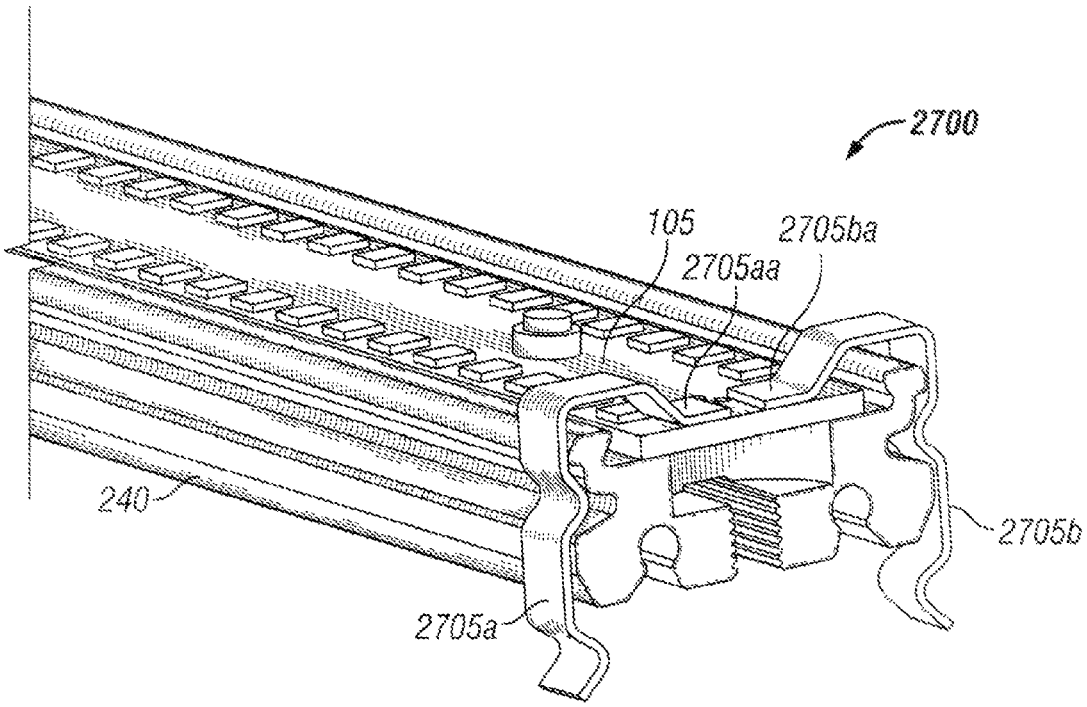
FIG. 27 illustrates an LED assembly, in accordance with certain additional alternative exemplary embodiments.
Figure 28:
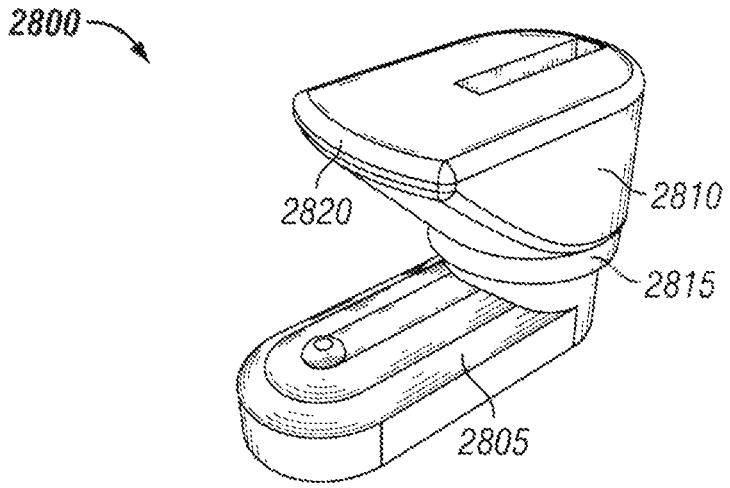
FIG. 28 illustrates a latching mechanism for securing a member to a mounting place, in accordance with certain additional alternative exemplary embodiments.
Figure 29A:
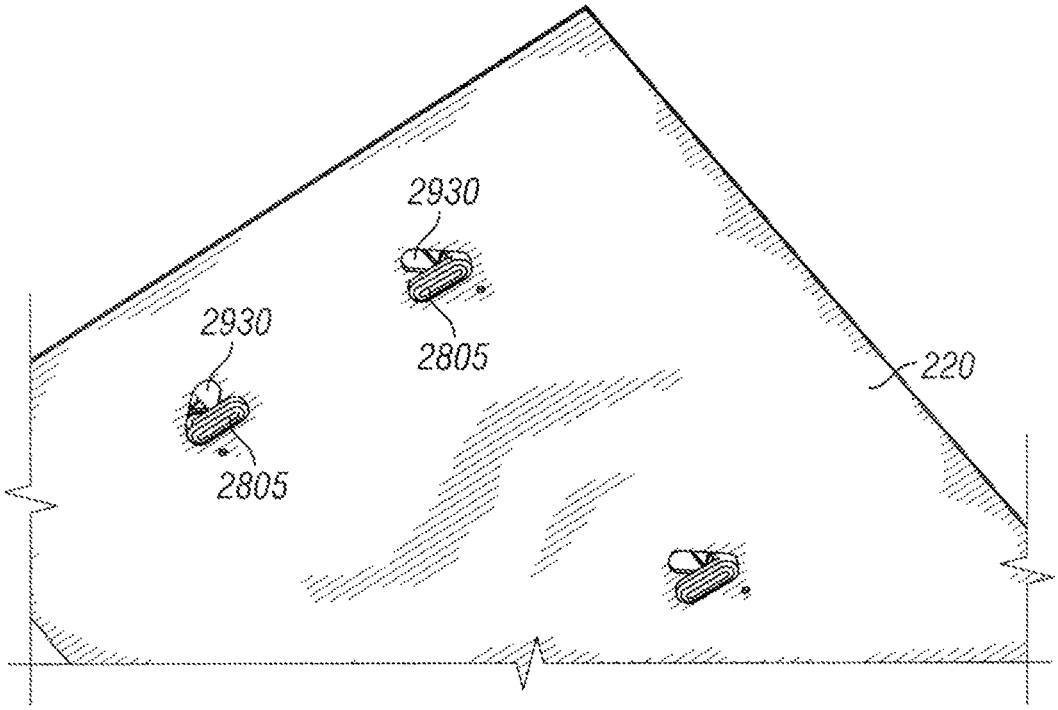
FIGS. 29A-C illustrate a latching system for securing a member to a mounting plate using the latching mechanism of FIG. 28, in accordance with certain additional alternative exemplary embodiments.
Figure 29B:
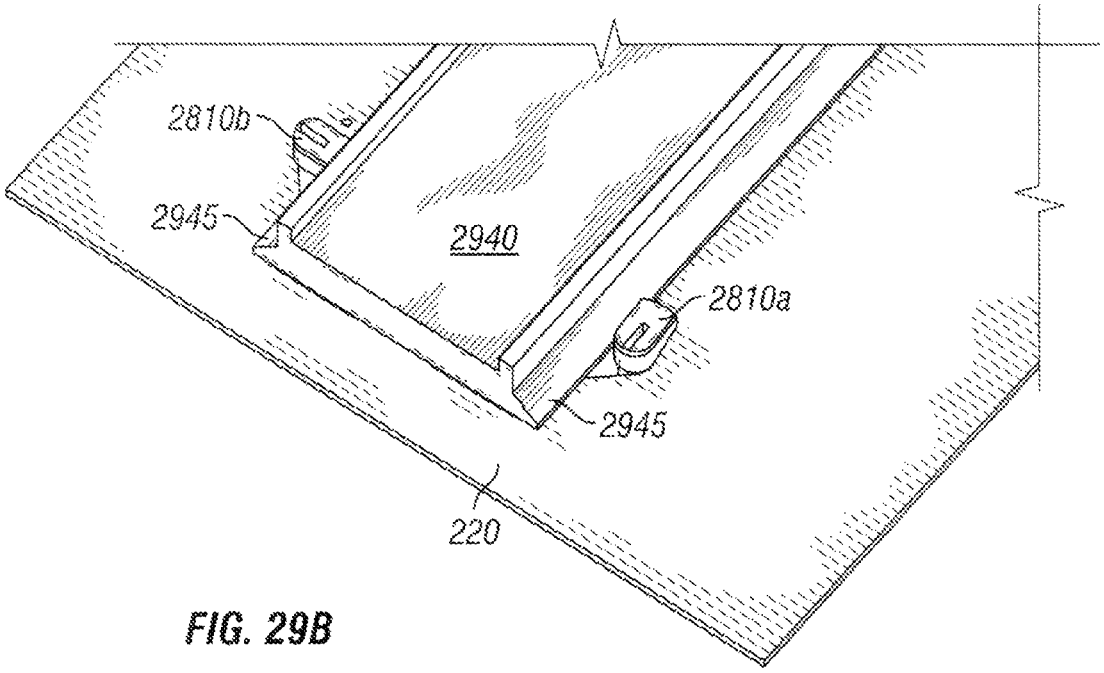
Figure 29C:
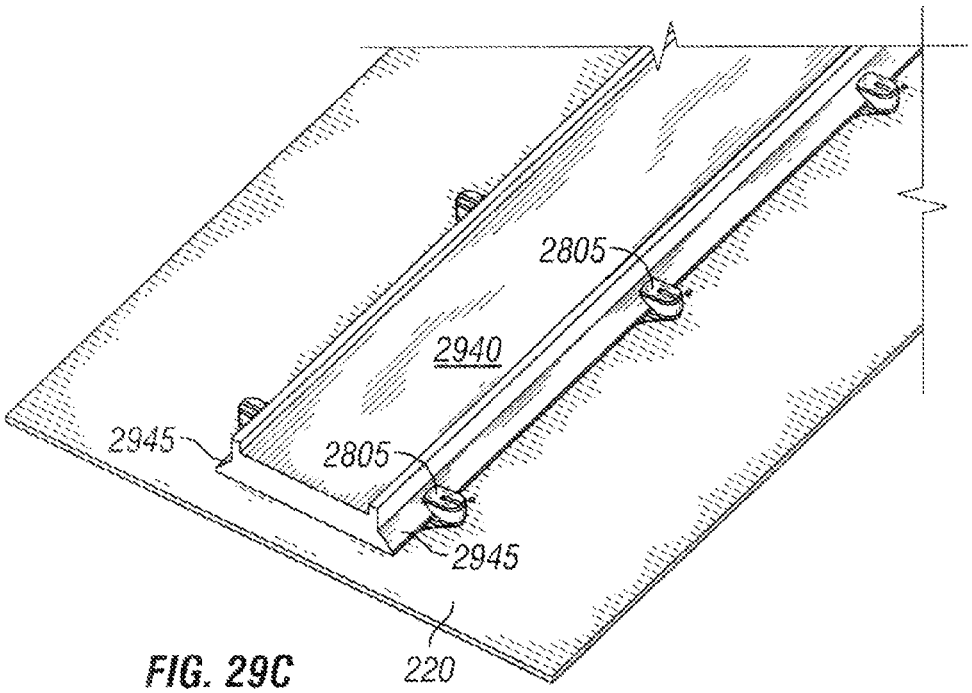

FIG. 27 illustrates an LED assembly 2700, in accordance with certain additional alternative exemplary embodiments. The LED assembly 2700 is similar to assembly 2600 described above, except that, instead of magnets mechanically and electrically coupling the LED modules 105, clips 2705*a* and 2705*b* mechanically and electrically couple the LED modules 105 to the desired surface. Like the magnets 2605*a* and 2605*b*, the clips 2705*a* have different polarities that allow power to be provided to the LED's of the LED modules 105 without the need for additional wires or other electrical connectors. Ends 2705*aa* and 2705*ba* of the clips 2705*a* and 2705*b*, respectively, rest on and engage a conductive top surface of the LED module 105, and current flows through a circuit, which includes the clips 2705*a* and 2705*b*, the conductive top surface of the LED module 105, and a power source (not shown) to which the clips 2705*a* and 2705*b* are coupled. For example, the clips 2705*a* and 2705*b* may be coupled to a powered surface, such as a rail and/or track.

FIGS. 28 and 29A-C illustrate a latching mechanism 2800 and a latching system 2900 for securing the member 2940 to a mounting plate 220, in accordance with certain additional alternative exemplary embodiments. The latching mechanism 2800 includes a lower member 2805 and an upper member 2810. In certain exemplary embodiments, the upper member 2810 is rotatably coupled to the lower member 2805 at the shaft 2815, such that upper member 2810 is capable of rotating independent of the lower member 2805. The upper member 2810 includes a flange or lip 2820 along one end that engages the member 2940 when installed. In certain exemplary embodiments, the upper member 2810 thins out as it extends from the axis of rotation to the lip 2820.

In operation, the lower member 2805 of the latching mechanism 2800 is placed within one of the apertures 2830 in the mounting plate 220. This is done for multiple latching members 2800 in two linear rows along the longitudinal axis of the member 2940. Once place in the aperture 2930, the lower member 2805 can be rotated to prevent if from coming back out of the aperture. While not shown, the bottom side of the mounting plate 220 can include flanges bumps or detents that prevent the bottom member 2805 for rotating back to a position where it can be removed from the aperture 2930.

Once the bottom members 2805 are positioned in the apertures 2930, the member 2940 is placed on the mounting plate 220 and the top member 2810 is rotated from a release position 2810*a* to a locked position 2810*b*. In the locked positioned 2810*b*, the lip 2820 of the latching mechanism 2800 engages or contacts a flange member 2945 that extends longitudinally along each of the two sides of the member 2940. In certain exemplary embodiments, the top members 2810 are rotated about 90 degrees to move them from the release position 2810*a* to the locked position 2810*b*.

Figure 30:
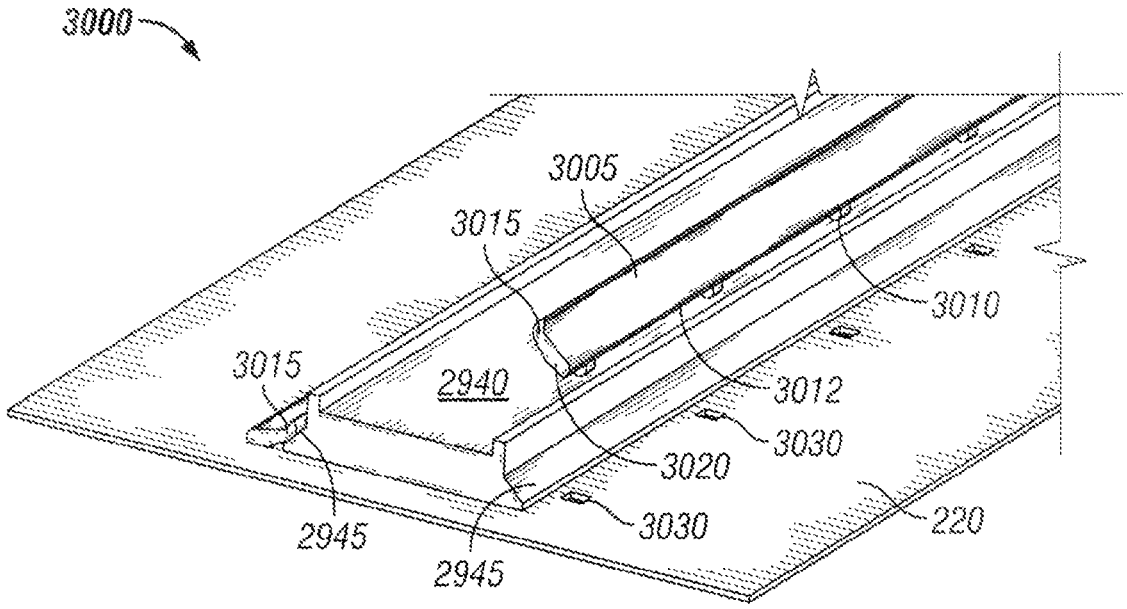
FIG. 30 illustrates another latching system for securing a member to a mounting plate, in accordance with certain additional alternative exemplary embodiments.

FIG. 30 illustrates a latching mechanism 3005 and a latching system 3000 for securing the member 2940 to a mounting plate 220, in accordance with certain additional alternative exemplary embodiments. The latching mechanism 3005 is a longitudinal member that extends the length of or a portion of the length on the longitudinal side of the member 2940. The longitudinal latching mechanism 3005 includes multiple tabs 3010 extending down from and spaced apart along a first side 3012 of the mechanism 3005. The mechanism 3005 also includes an opposing second side 3015 that engages or is disposed adjacent to the flange 2945 of the member 2940. Between the first side 3012 and the second side 3015 is a retaining side 3020. The retaining side 3020 can be straight or have a shape that is complementary to the shape of the flange 2945 to rest against the flange 2945 and hold the member 2940 in place.

In operation, the member 2940 is placed on the mounting plate 220. Each tab 3010 of the latching mechanism 3005 is placed within one of the apertures 3030 in the mounting plate 220. Once the tabs 3010 are positioned in the apertures 3030, the retaining side 3020 rests against or applies a force along the flange 2945 of the member to hold the member 220 in place. In an alternative embodiment, once the tabs 3010 are positioned in the apertures 3030, the second side 3015 of the mechanism 3005 is rotated towards the flange 2945 until the retaining side 3020 engages the flange 2945.

Although specific embodiments of the claimed invention have been described above in detail, the description is merely for purposes of illustration. It should be appreciated, therefore, that many aspects of the claimed invention were described above by way of example only and are not intended as required or essential elements of the claimed invention unless explicitly stated otherwise. Various modifications of, and equivalent steps corresponding to, the disclosed aspects of the exemplary embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

What is claimed is:

1. A light emitting diode ("LED") assembly, comprising:
a first LED module comprising:
a first plurality of LEDs; and
a first substrate upon which the first plurality of LEDs are disposed, wherein the first substrate comprises a first wire receiver disposed at a distal end of the first substrate;
a second LED module coupled to the first LED module, wherein the second LED module comprises:
a second plurality of LEDs; and
a second substrate upon which the second plurality of LEDs are disposed, wherein the second substrate comprises a second wire receiver disposed at a proximal end of the second substrate;
an electrically conductive first wire having a first end and a second end, wherein the first end of the first wire is removably coupled to the first wire receiver of the first LED module, and wherein the second end of the first wire is removably coupled to the second wire receiver of the second LED module;
a member upon which the first LED module and the second LED module are disposed;
a mounting plate comprising a first opening and a second opening; and
at least one spring clip coupled to the mounting plate and the member, wherein the at least one spring clip extends through the first opening in the mounting plate, and wherein the at least one spring clip comprises first opposing ends that engage the member.

2. The LED assembly of claim 1, further comprising:
a third LED module coupled to the first LED module, wherein the third LED module comprises:
a third plurality of LEDs; and
a third substrate upon which the third plurality of LEDs are disposed, wherein the third substrate comprises a third wire receiver disposed on the distal end of the third substrate; and
an electrically conductive second wire having a third end and a fourth end,
wherein the first substrate further comprises a fourth wire receiver disposed on a proximal end of the first substrate,
wherein the third end of the second wire is removably coupled to the third wire receiver of the third LED module, and wherein the fourth end of the second wire is removably coupled to the fourth wire receiver of the first LED module.

3. The LED assembly of claim 1, wherein the first connector receiver and the second connector receiver are disposed substantially orthogonally with respect to one another.

4. The LED assembly of claim 1, wherein the first connector receiver is disposed along a surface beneath the first plurality of LEDs.

5. The LED assembly of claim 1, wherein the first connector receiver is not visible when the distal end of the first LED module and the proximal end of the second LED module abut against each other.

6. The LED assembly of claim 1, wherein the first wire receiver of the first LED module extends from a top side of the first LED module.

7. The LED assembly of claim 1, wherein the distal end and a proximal end of the first substrate are longitudinal ends of the first substrate.

8. The LED assembly of claim 1, wherein the first wire receiver of the first substrate and the second wire receiver of the second substrate are also mechanically coupled to each other when the first LED module and the second LED module abut against each other.

9. The LED assembly of claim 1, further comprising:
a member onto which the first LED module is mounted, wherein the member comprises at least one longitudinal side to which at least one end of at least one spring clip engages.

10. A light emitting diode ("LED") assembly, comprising:
a mounting plate comprising at least one opening;
a LED module, wherein the LED module comprises:
a plurality of LEDs; and a substrate upon which the plurality of LEDs are disposed, wherein the substrate comprises a connector receiver disposed at a distal end of the substrate;

a member disposed on the mounting plate and upon which the substrate of the LED module is disposed; and a spring clip coupled to the member and the mounting plate, wherein the spring clip extends through the opening in the mounting plate, and wherein the spring clip comprises opposing ends that engage the member.

11. The LED assembly of claim 10, wherein the spring clip comprises at least one snap-in feature that secures the spring clip to the mounting plate.

12. The LED assembly of claim 11, wherein the spring clip creates a physical separation between the member and the mounting plate.

13. The LED assembly of claim 10, wherein power is supplied to the LED module using the spring clip.

14. The LED assembly of claim 1, wherein the first LED module and the second LED module are positioned relative to each other to appear as a continuous array of LEDs.

15. The LED assembly of claim 1, wherein the first wire receiver is a wire terminal block.

* * * * *